US006905391B2

(12) United States Patent
Soto et al.

(10) Patent No.: US 6,905,391 B2
(45) Date of Patent: Jun. 14, 2005

(54) SCANNING TOY

(75) Inventors: Jorge Gabriel Soto, Antioch, CA (US); Kathleen Campisano, Danville, CA (US); Richard Glen Freeman, San Carlos, CA (US); Eric Thomas Shuler, Piedmont, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 0 days.

(21) Appl. No.: 10/338,091

(22) Filed: Jan. 6, 2003

(65) Prior Publication Data

US 2003/0171063 A1 Sep. 11, 2003

Related U.S. Application Data

(60) Provisional application No. 60/346,456, filed on Jan. 5, 2002.

(51) Int. Cl.[7] ..... A63H 5/00

(52) U.S. Cl. ..... 446/397; 446/175; 434/169

(58) Field of Search ..... 446/483, 404, 446/175, 484, 486, 491, 397; 434/116, 187, 110, 393, 308, 365, 314–317; 235/435, 472, 493, 383, 382, 462, 380, 169

(56) References Cited

U.S. PATENT DOCUMENTS 3,883,146 A * 5/1975 Johnson et al. ..... 369/75.1
4,234,761 A * 11/1980 Wiggins et al. ..... 704/258
4,604,065 A 8/1986 Frazer
4,990,093 A * 2/1991 Frazer et al. ..... 434/337
5,314,336 A * 5/1994 Diamond et al. ..... 434/169
5,444,223 A * 8/1995 Blama ..... 235/435
5,476,407 A 12/1995 Hall, Jr.
5,478,989 A * 12/1995 Shepley ..... 235/375
5,640,002 A * 6/1997 Ruppert et al. ..... 235/462.46
5,816,886 A 10/1998 Cusolito
6,017,260 A * 1/2000 Dolan ..... 446/298
6,089,943 A * 7/2000 Lo ..... 446/175
6,142,784 A * 11/2000 Wood ..... 434/201
6,264,523 B1 * 7/2001 Simmons ..... 446/143
6,361,396 B1 * 3/2002 Snyder et al. ..... 446/397
6,364,735 B1 4/2002 Bristow et al.
6,421,524 B1 * 7/2002 Padgett ..... 434/317
6,484,939 B1 11/2002 Blaeuer
6,532,314 B1 * 3/2003 Plain et al. ..... 382/312
6,650,870 B2 11/2003 White et al.
2002/0197589 A1 * 12/2002 Wood et al. ..... 434/201
2003/0024975 A1 2/2003 Rajasekharan
2003/0089777 A1 5/2003 Rajesekharan
2003/0138766 A1 7/2003 Au
2004/0229195 A1 11/2004 Marggraff

OTHER PUBLICATIONS

Web page, "Cash Register with Scanner", at URL=http://www.amazon.com/exec/obidos/tg/detail/–/B00005LBYL/102–3860054–1792958?v=glance&s=toys&vi=pictures&img=14#more–pictures, printed Jun. 11, 2003.

* cited by examiner

*Primary Examiner*—Derris H. Banks
*Assistant Examiner*—Alex F. R. P. Rada, II
(74) *Attorney, Agent, or Firm*—Townsend and Townsend and Crew LLP

(57) ABSTRACT

An interactive shopping role-play toy comprises a toy item bin, a first set of toy items replicating shopping items, an input device adapted to uniquely identify each of the toy items; and an audio playback device adapted to play an audio acknowledgment associated with the identified toy item. The audio acknowledgement is uniquely associated with the identified toy item. The input device is configured to uniquely identify a toy item when the toy item is within physical proximity of the input device. Each toy item includes an RF identification tag corresponding to a unique electronic identification, and the input device includes an RF identification tag reader.

28 Claims, 13 Drawing Sheets

Learning mode

-Numbers
-Information About Food Items
-Colors

Explore mode

-Nutritional Information

Game mode

-Numbers

FIG. 9

SCANNING TOY

CROSS-REFERENCES TO RELATED APPLICATIONS

This application claim priority to U.S. Provisional Patent Application No. 60/346,456, filed on Jan. 5, 2002, which is incorporated by reference herein for all purposes.

BACKGROUND OF THE INVENTION

Children enjoy emulating common adult activities. Role-play toys allow children to pretend to engage in adult activities. One common adult activity often emulated by children is shopping. Many role-play toys resemble items that adults encounter when shopping. For example, non-interactive toy shopping carts and fake food items are popular toys for young children. These toys offer children open-ended, imaginative play experiences. However, the non-interactive nature of shopping role-play toys allows few opportunities for educational enrichment. Additionally, children quickly become bored with non-interactive toys.

It is desirable to improve traditional shopping toys with interactive audio and/or visual output to provide educational enrichment and a superior play experience.

SUMMARY OF THE INVENTION

Embodiments of the invention include toys including a scanner, as well as kits that include scannable toy items.

One embodiment of the invention is directed to a toy, comprising: (a) a scannable toy item; (b) an electronic scanner configured to identify the scannable toy item when the electronic scanner is brought within physical proximity to the scannable toy item; and (c) an audio playback device electronically coupled to the electronic scanner, wherein the audio playback device is configured to play an audio output that is uniquely associated with the scannable toy item.

Another embodiment of the invention is directed to a toy, comprising: (a) a container; (b) a plurality of toy items, each toy item of the first plurality replicating a shopping item; (c) an input device adapted to uniquely identify each of the toy items; and (d) an audio playback device adapted to play an audio output associated with the identified toy item.

Another embodiment of the invention is directed to a kit comprising: (a) a plurality of scannable toy items; and (b) a plurality of RF (radio frequency) identification tags respectively associated with the plurality of scannable toy items, wherein the RF identification tags are capable of being read by a scanner comprising an RF identification tag reader.

Another embodiment of the invention is directed to a kit comprising: (a) a plurality of scannable toy-items; (b) a plurality of identification tags respectively associated with the plurality of scannable toy items; and (c) a transferable information storage medium comprising code for audio corresponding to the plurality of scannable toy items.

These and other embodiments of the invention are described in further detail below.

BRIEF DESCRIPTION OF THE DRAWINGS

Embodiments of the invention will be described with reference to the figures, in which.

DETAILED DESCRIPTION

Figure 1:
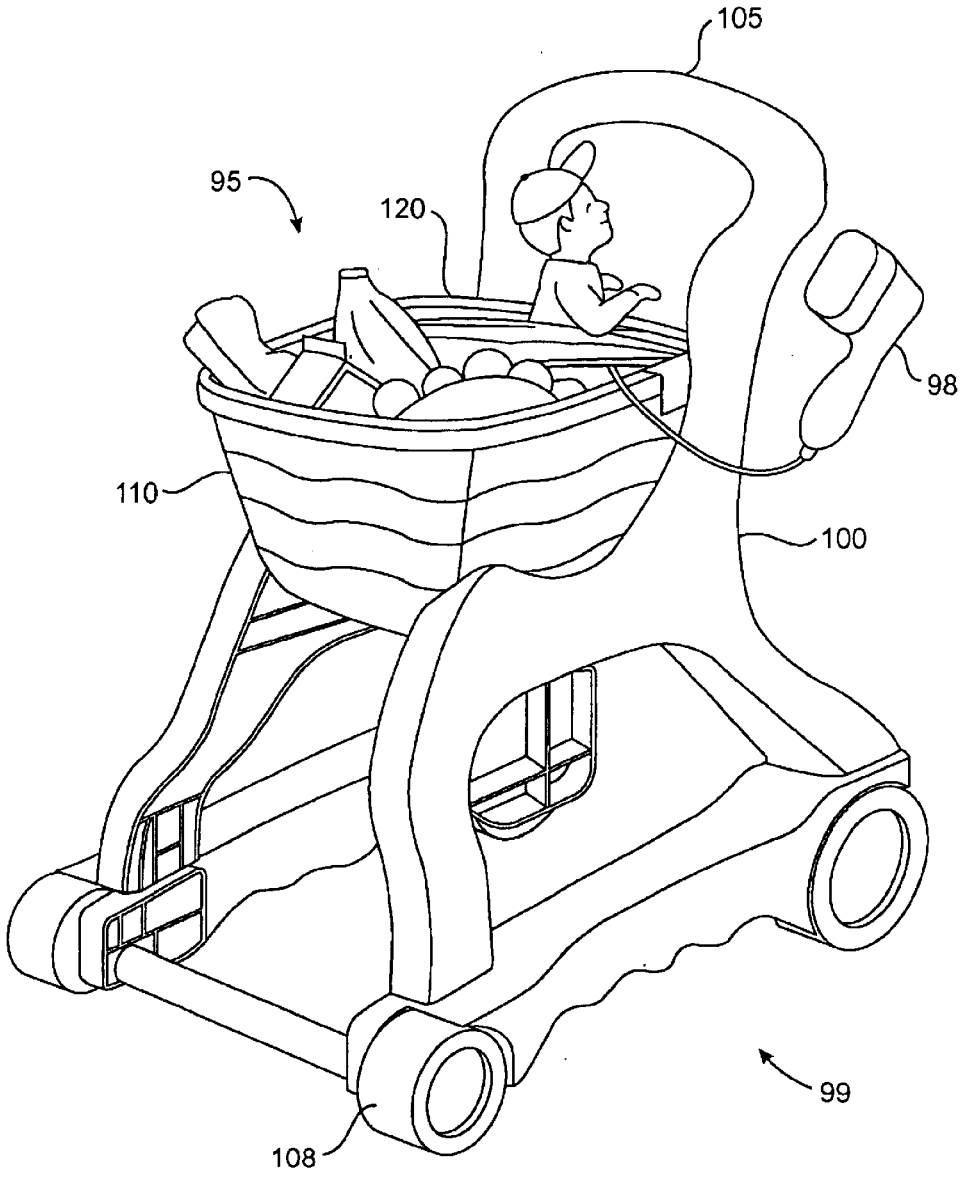
FIG. 1 illustrates an embodiment of an interactive shopping role-play toy having a scanner.

As noted above, one embodiment of the invention is directed to a toy comprising a scannable toy item and an electronic scanner configured to identify the scannable toy item when the electronic scanner is brought within physical proximity to the scannable toy item. An audio playback device is electronically coupled to the electronic scanner, and is configured to play an audio output that is uniquely associated with the scannable toy item.

In some embodiments, the toy comprises a toy shopping cart equipped with an electronic scanner. The electronic scanner can resemble a handheld bar code scanner commonly used by cashiers in stores. The electronic scanner can be configured to identify a toy shopping item, much as a real hand-held bar code scanner identifies real shopping items. The interactive shopping role-play toy generates one or more audio outputs in response to the identification of the toy shopping item.

In embodiments of the invention where a scanner is used, a "scannable toy item" can refer to an item that can be electronically scanned by a scanner (i.e., the toy item can be electronically identified without physically contacting the scanner). A "non-scannable toy item" can be an item that cannot be scanned (i.e., the scanner cannot electronically identify the scanned item). In preferred embodiments, the scannable and non-scannable toy items are role-play toy items. Role-play toy items are toy representations of other real life items such as food items. In other embodiments, the scannable and non-scannable toy items could be non-role play toy items such as blocks with numbers, letters, and/shapes on them.

To scan a scannable toy item, the scanner can be brought into close physical proximity to the scannable toy item (e.g., less than 1 inch). The scanner can electronically identify the scannable toy item even though the scanner does not come into contact with the scannable toy item. As with an ordinary scanner, the scanner could come into contact with the scannable toy item, and can still electronically identify the scannable toy item.

Once the scannable toy item has been scanned, an audio playback device plays back audio outputs that correspond to the scannable toy item. For example, if the scannable toy item is a molded plastic representation of two chicken legs, then upon scanning the two chicken legs, the audio playback device may produce the output "two chicken legs".

A scanner is one example of a suitable input device that can be used with the toy to produce unique audio outputs. In other embodiments, a suitable input device may be a keyboard that is on, for example, a shopping cart. In this example, a toy food item may have a number on the toy item and the child may input the number of the toy into the keyboard and subsequently receive a unique audio output corresponding to the toy food item.

As shown by the examples below, the audio playback device can also prompt the user before the user scans a scannable toy item. For example, the audio playback device can prompt the user in a game mode by providing the output "Can you find two chicken legs?" Specific examples of audio playback devices are provided below. In some embodiments, an audio playback device may include (i) a memory comprising code for pre-recorded audio segments and/or pre-recorded audio outputs, and code for any operating instructions for playing back audio after receiving the identity of a scanned toy item, (ii) a processor, (iii) an amplifier, and (iv) a speaker.

Thus, embodiments of the invention can provide audio outputs that are "uniquely" associated with the scannable toy items. For example, the unique audio output "You found one carton of milk!" may be unique to a scannable toy item in the form of one carton of milk. A unique audio output may be comprised of a specific combination of pre-recorded audio segments (as shown below), where the segments would be recombined in other ways to produce other unique audio outputs. Alternatively, the unique audio output could be a pre-recorded audio output without combinable audio segments.

Unique audio outputs are contrasted with non-unique audio outputs such as "beeping" that might occur when scanning food items in a regular grocery store. Of course, as shown in the examples below, non-unique audio outputs such as beeping sounds or generic audio outputs (e.g., "super!") could be used in conjunction with unique audio outputs. A generic audio output can be an audio output that would be appropriate for any scannable toy item, and not for just one particular scannable toy item.

The unique audio outputs can describe various attributes of the scannable toy items. For example, the attribute may include the scannable toy item's color, shape, name, texture, size, etc. The attribute could also relate to the number of objects that are represented by the scannable toy item. For example, a single scannable toy item may include a molded plastic representation of seven molded cherries. In this example, a unique audio output may be "You found seven cherries!"

FIG. 1 illustrates an embodiment of an interactive shopping toy 99. In this embodiment, the interactive shopping toy 99 includes a shopping cart 100 and an electronic scanner 98 coupled to the shopping cart 100.

The shopping cart 100 has a size, weight, and construction so that it can be used by children. For example, the shopping cart 100 can have dimensions that are less than 3 $ft^3$. While the children may be of any suitable age, the children can be less than about 10 years of age in some embodiments (e.g., 3–8 years of age). Shopping cart 100 includes a handle 105 to allow children to push the cart. Wheels 108 allow children to easily move the shopping cart 100. A container 110 in the form of a basket is adapted to hold scannable or non-scannable shopping items, or other toys selected by the child. Scannable toy items 95 are in the container 110. A control console 120 is near the handle 105 and provides access to the interactive features of shopping cart 100.

While the illustrated shopping toy 99 embodiment is illustrated as having a shopping cart, it is understood that other embodiments are also possible. The shopping toy 99 according to embodiments of the invention may include any suitable container. For example, in other embodiments, instead of a shopping cart, the shopping toy can include a shopping basket without wheels that a person could carry with the person's hands.

Figure 2:
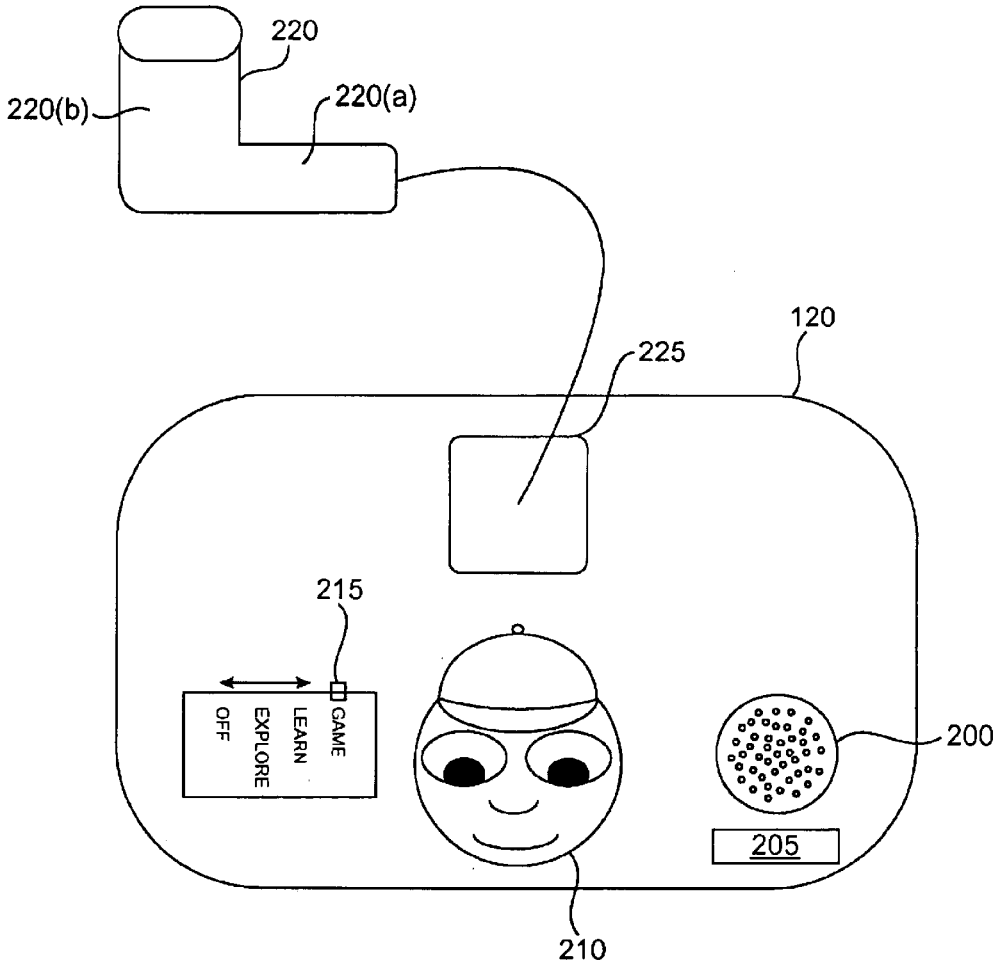
FIG. 2 illustrates an embodiment of a control console for a shopping role-play toy.

FIG. 2 illustrates an embodiment of a control console 120. Control console 120 includes a speaker 200 for providing audio output. While any suitable audio outputs can be produced, the audio outputs provided by this specific embodiment include sound effects, music, and speech. The audio output can be generated by a digital (or analog) audio device that either produces sound or plays one or more pre-recorded audio phrases. The use of digital audio devices to play pre-recorded audio phrases or to generate sound is well known in the art. Additionally, volume switch 205 allows a child (or parent) to select an audio output volume from the speaker 200.

Character switch 210 is configured to receive input from a child during interactive play. To facilitate interaction with children, character switch 210 can be a durable figurine designed to attract a child's attention, such as an anthropomorphic tadpole ("Tad") or other cartoon-like character. To activate the character switch 210, a child can toggle the character switch 210.

Mode switch 215 allows a child or parent to select one of a plurality of operating modes for the shopping cart 100. The shopping cart 100 provides different educational activities depending upon the interactive operating mode selected by mode switch 215. Exemplary modes include a game mode, a learn mode, and an explore mode. Operating code for any of these modes and for any other function described herein can be created by those of skill in the art and can be stored in a memory associated with the toy.

In an example game mode, a child can shop for food items on a predetermined food list. The toy may ask a child to find food items. For example, the toy may say, "Let's make a fruit shake! My list says we need strawberries and bananas." If a correct item is scanned, the toy congratulates the child and encourages him/her to find a second item. If an incorrect item is scanned, the toy helps the child find the correct item by offering a clue about the color of the food. For example, the toy may say "the bananas are yellow". A button or other device may be pressed to receive a clue.

In an exemplary learn mode, a child can scan any food item to hear the quantity of food objects in the food item (e.g., 3 bananas in a molded representation of 3 bananas). If the food item is scanned a second time, the toy can compare its quantity to the previous food item scanned. For example, if the child scans the bananas first, and then scans eggs (e.g., a plastic representation of five eggs in a single body) a second time, the toy will say "we have more eggs than bananas."

In an exemplary explore mode, a child can scan any food item to hear the name of the food item and its quantity. If the food item is scanned again, the color, food group, and nutritional benefit and a fun fact about the food item can be played.

Scanner 220 resembles a handheld bar code scanner. Scanner 220 includes a hand grip 220(*a*) and a scanning head 220(*b*), and is configured to operate in conjunction with shopping items, as discussed below. In some embodiments, scanner 220 can be stored in receptacle 225. An electrical cord 230 electrically and mechanically couples the scanner 220 to the shopping cart 100. Alternate embodiments may use wireless communications in place of the electrical cord 230.

Figure 3:
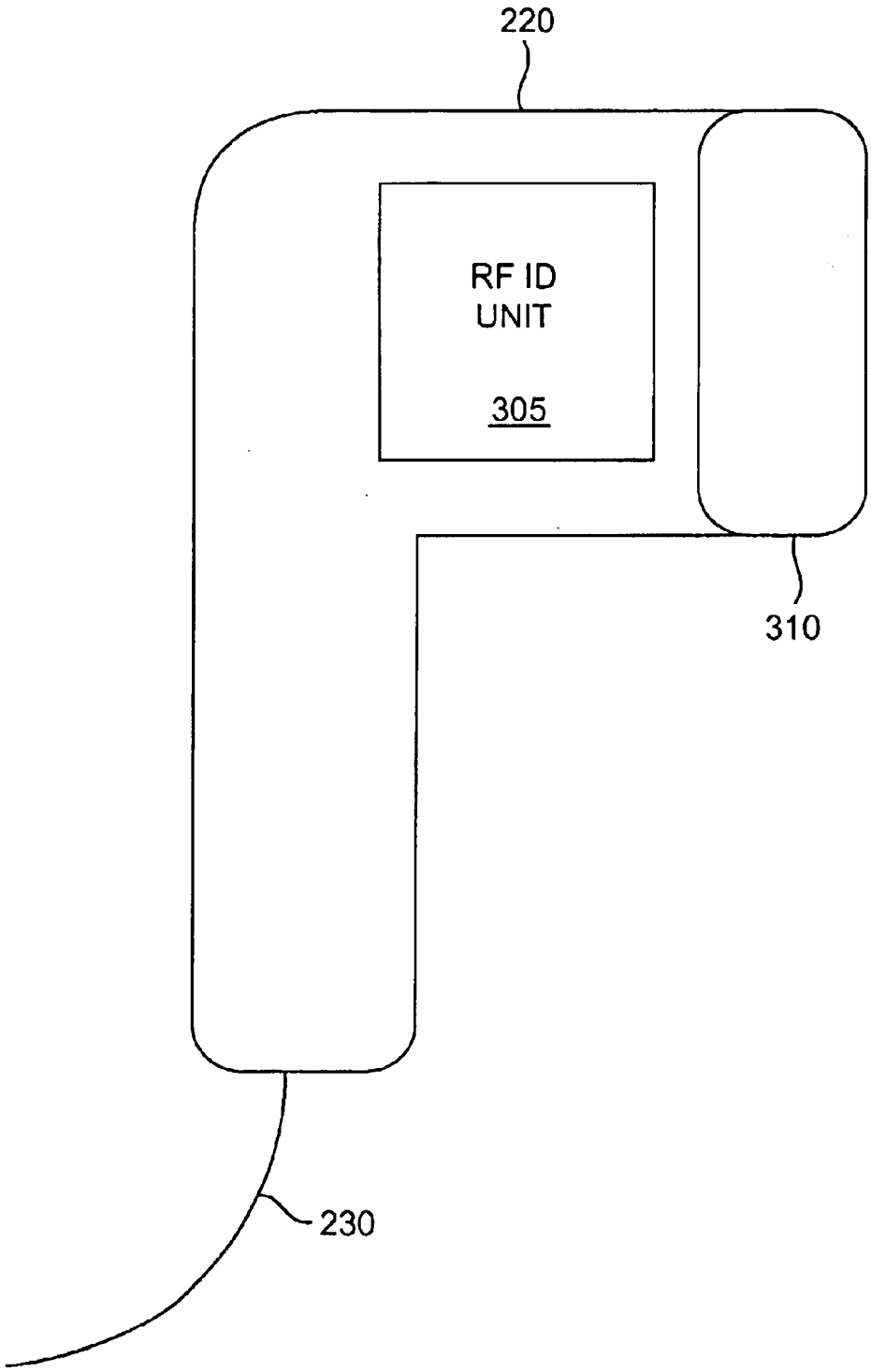
FIG. 3 illustrates an embodiment of a scanner used by an interactive shopping role-play toy.

FIG. 3 illustrates an embodiment of a scanner 220. Scanner 220 includes pressure sensitive switch 310 located at the tip of scanner 220. Pressure sensitive switch 310 can signal to the shopping cart 100 when a child attempts to scan either a scannable toy item such as a scannable shopping item or a non-scannable toy item. Whether or not the pressure sensitive switch 310 is depressed, RF identification unit 305 emits a radio frequency (RF) scanning signal. RF identification unit 305 receives a response signal to the scanning signal when a scannable toy item containing a RF identification tag is brought within close physical proximity (e.g., less than one inch away from each other) to the RF identification unit 305. Physical contact between the scanner 220 and the scannable toy item is not necessary to scan the scannable toy item. The response signal is used by the RF identification unit 305 to identify the item scanned. In some embodiments, the RF identification tag is a passive device that generates a response signal from the energy of the scanning signal. The design and use of RF identification tags to identify objects is well known in arts such as the art of electronic devices (e.g., as used in electronic identification badges). In an alternate embodiments, scanner 220 can identify objects using an optical scanner, such as bar code readers, or other active or passive identification devices.

Figure 4A:
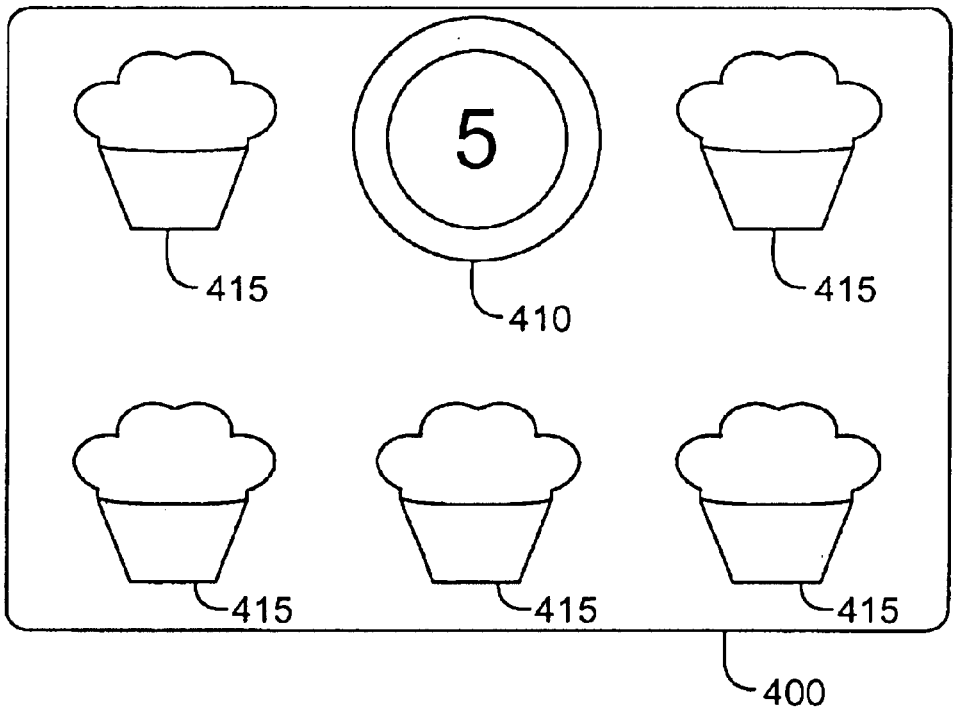
FIGS. 4A and 4B illustrate toy shopping items used in conjunction with an embodiment of an interactive shopping role-play toy.

FIG. 4A illustrates a scannable toy item in the form of a shopping item 400. The shopping item 400 can be used with the shopping cart 100. Any suitable scannable toy item can be used in embodiments of the invention. Exemplary shopping items may be role-play toy items such as play food items, play household items (e.g., mops, sponges, brooms), and play tools (e.g., hammers, screwdrivers, drills, etc.). In other embodiments, scannable toy items need not be role-play toy items. For example, the scannable toy items could be blocks with letters, numbers, or colors on them. In these embodiments, a child may use these non-role play scannable toy items, and then can receive audio outputs in response to scanning.

Shopping item 400 includes an RF identification tag (not shown) or other identification device embedded just below its surface at location 410. When shopping item 400 is brought within close physical proximity of scanner 220, RF identification unit 305 or other equivalent identification device identifies the shopping item 400. The shopping cart 100 then outputs an audio response to the identification of the shopping item 400. To help the user scan the shopping item 400, location 410 is marked with distinctive logo. The logo serves as a target for the scanner 220. The child may be prompted to scan the logo on the shopping item 400.

The appearance of shopping item 400 and location 410 facilitates educational enrichment. In one embodiment, shopping item 400 resembles a food item. Each food item may have one or more food objects. When a shopping item is scanned, the shopping cart 100 outputs audio that identifies the food item or attributes of the food item, such as nutritional information, or the shape or color of the food item. This embodiment introduces children to food names, nutritional information, shapes, and colors.

Alternatively or additionally, shopping item 400 resembles a specific quantity of objects. For example, shopping item 400 is in the form of a single, unitary body, but includes a set of five objects 415. Set 415 may resemble five food objects, for example five cupcakes. When a shopping item is scanned, the shopping cart 100 outputs audio identifying the quantity of objects. In further embodiment, each shopping item is associated with a number. This number may be written on the shopping item. The number is incorporated into the scanning logo at location 410. These embodiments help children teach children to count and to associate the quantities of objects with the corresponding numbers.

In some embodiments, a group of scannable toy items may form a "play pack" that may or may not correspond to a particular theme. If the play pack does correspond to a particular theme, then various non-scannable toy items can be included in the play pack along with scannable toy items.

The play packs can have any suitable theme. For example, a barbeque play pack may include scannable toy items such as ketchup, mustard, hot dog, bun, and chips. In a health and safety play pack, scannable toy items may include a toothbrush, toothpaste, comb, etc. In a tea party play pack, scannable toy items may include a tea pot, cups, cookies, finger sandwiches, etc. Other examples of play packs with examples of scannable and non-scannable toy items are included in Tables 1–3. Table 1 lists items in a basic grocery "packout" play pack that can come with a base shopping cart. Table 2 lists scannable and non-scannable toy items in a picnic play pack. Table 3 lists scannable and non-scannable toy items in a birthday play pack.

Expansion packs of scannable toy items can be sold separately. In one embodiment, the audio outputs for the expansion sets are preprogrammed into a memory in the toy. If a parent purchases an expansion set, the phrases associated with the expansion set are automatically activated upon scanning an expansion set shopping item. In other embodiments, the audio outputs that correspond to the scannable toy items in each of these play packs may be included in a separate transferable information storage medium, instead of being in a memory in the shopping cart. Such play packs can be sold with the transferable information storage medium to form a kit. Examples of transferable information storage media include data cartridges.

TABLE 1

| SCANNABLE TOY ITEMS INCLUDED WITH BASE SHOPPING CART |
|---|
| 1 white carton of milk |
| 2 pink pork chops |
| 3 yellow bananas |
| 4 orange carrots |
| 5 blue boxes of cereal |
| 6 white eggs |
| 7 red cherries |
| 8 brown muffins |
| 9 green peas |
| 10 red strawberries |

TABLE 2

| SCANNABLE TOY ITEMS INCLUDED WITH PICNIC ACCESSORY PACK | NON-SCANNABLE TOY ITEMS INCLUDED WITH PICNIC ACCESSORY PACK |
|---|---|
| 1 red slice of watermelon with seeds | checkered picnic cloth |
| 2 yellow ears of corn | picnic basket |
| 3 green apple juice boxes | |
| 4 ink cookies | |
| 5 brown chicken legs | |
| 6 purple grapes | |

TABLE 3

| SCANNABLE TOY ITEMS INCLUDED WITH BIRTHDAY ACCESSORY PACK | NON-SCANNABLE TOY ITEMS INCLUDED WITH BIRTHDAY ACCESSORY PACK |
|---|---|
| white birthday cake with holes for candles and Happy Birthday written on top (e.g. shaped like a star) | 2 party noise makers (blowers) |
| a package of 5 green candles | 5 non-scannable green candles |
| a birthday present with a yellow bow on top | |
| a package of red party hats | 2 non-scannable party hats |
| a birthday banner | |

Figure 4B:
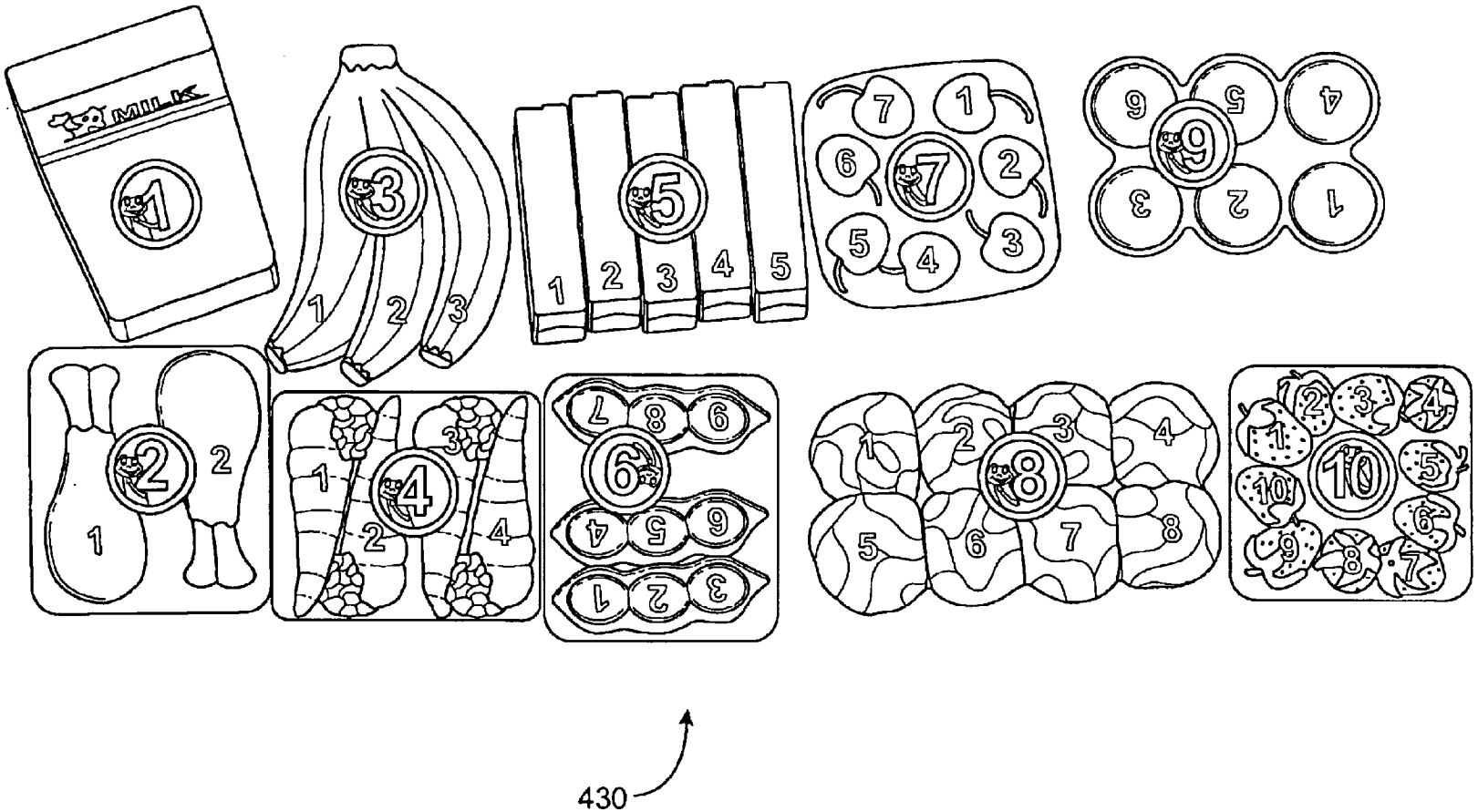

FIG. 4B illustrates a set of ten shopping items 430 (corresponding to those listed in Table 1) configured for use in conjunction with the shopping cart 100. The shopping items of set 430 are arranged similarly to shopping item 400. Each shopping item of set 430 contains an RF identification tag or other identification device. In an embodiment, the shopping items of set 430 each contain a unique identification tag such that scanner 220 can differentiate between the shopping items of the set. Shopping cart 100 uses the unique identification associated with each shopping item of set 430 to output a specific audio response for each shopping item of set 430.

Each shopping item of set 430 is associated with a different food. In a further embodiment, each shopping item of set 430 represents a specific quantity of a food. In this embodiment, set 430 contains shopping items representing quantities of food objects between one and ten. Further, each shopping item of set 430 is marked with a corresponding number as discussed above.

Figure 5A:
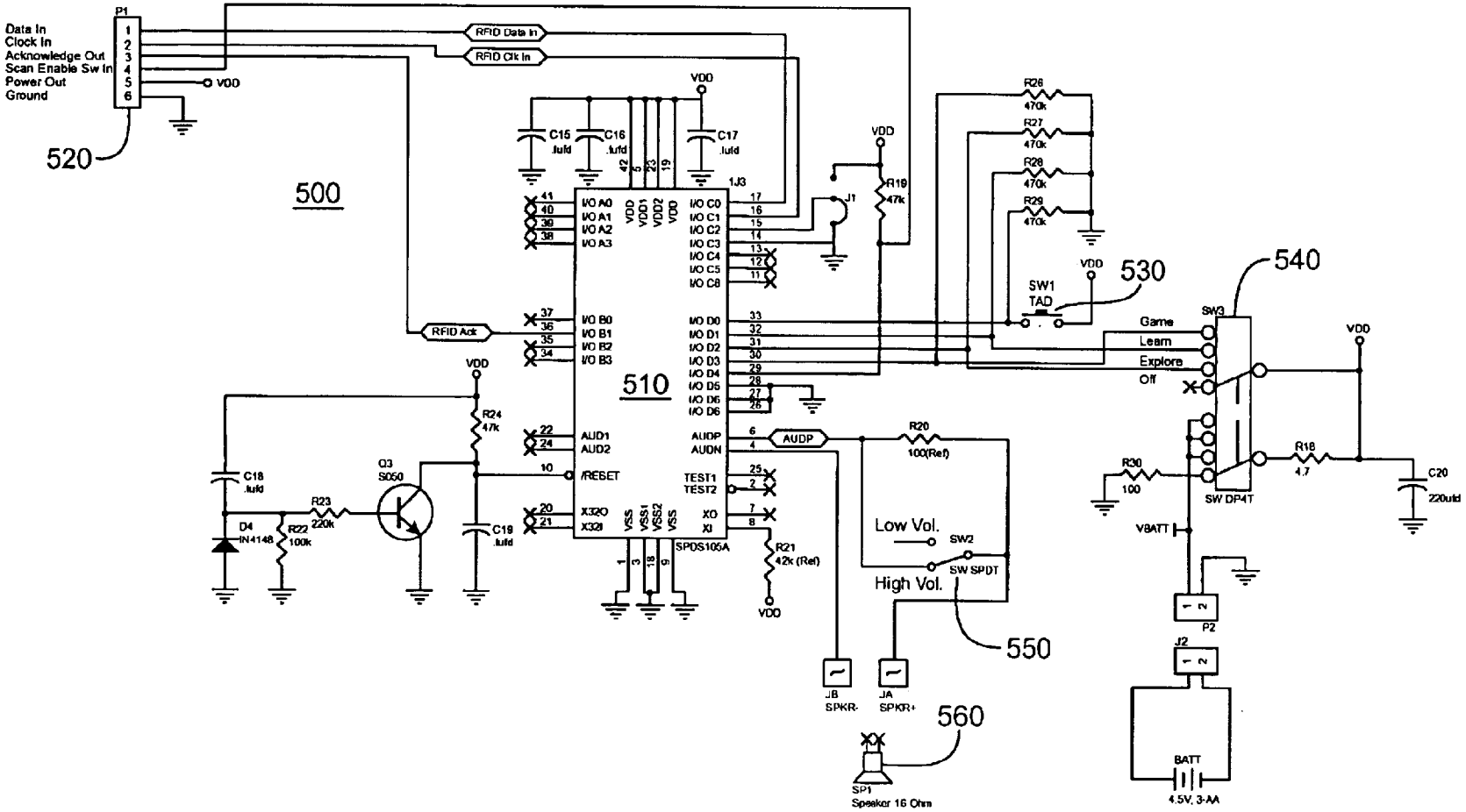
FIGS. 5A and 5B illustrate a schematic diagrams of an embodiment of an interactive shopping role-play toy.
Figure 5B:
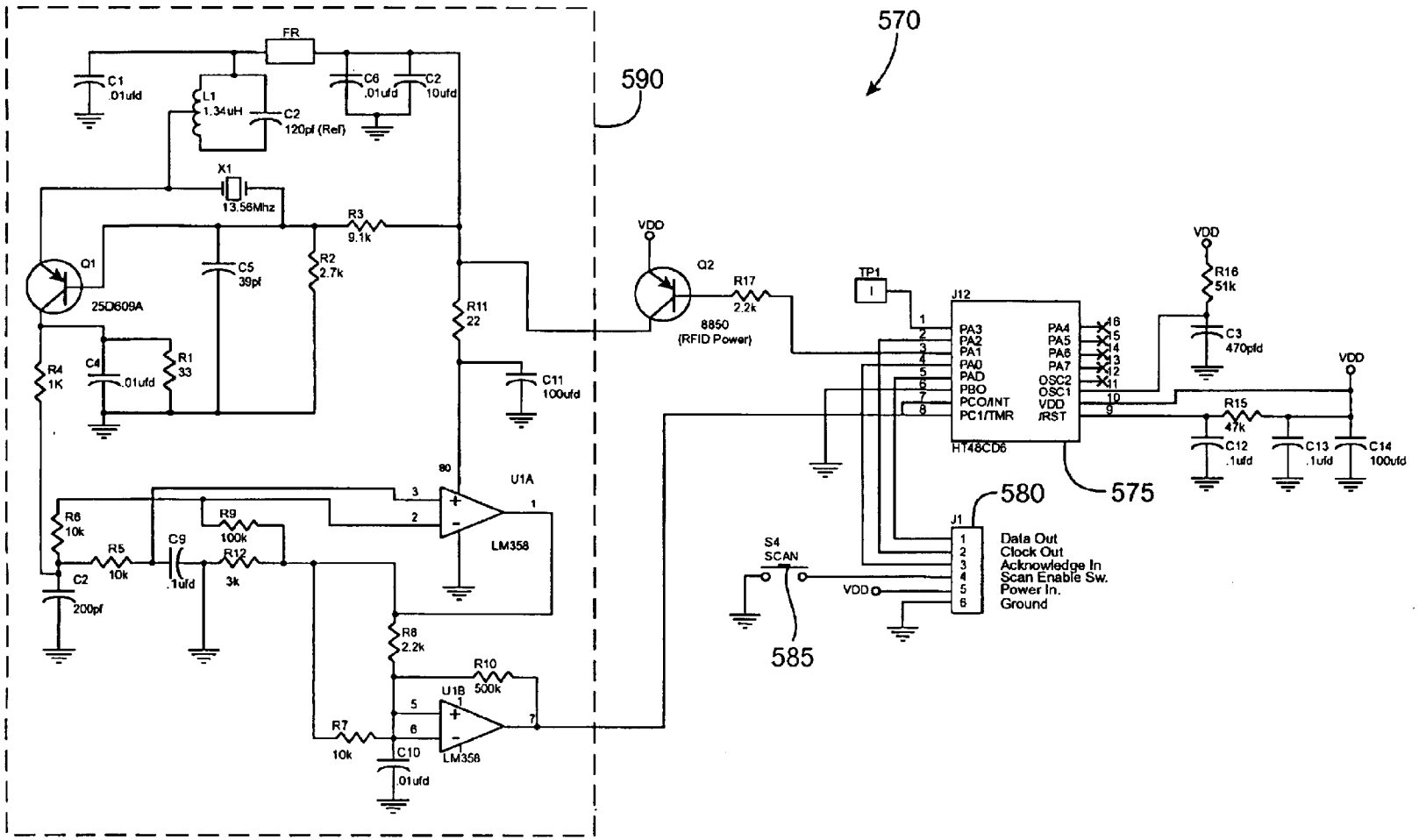

FIGS. 5A and 5B illustrate schematic electrical diagrams of circuits that can be used with the shopping toy. In schematic 500, a control device 510 and an input data port 520 are coupled together, and they receive input signals from scanner 220, or other identification devices. In this embodiment, a serial data interface is used. However, other embodiments may use other types of data interfaces. Additional input devices 530, 540, and 550 including mode, volume and character switches are connected as shown. Control device 510 can be a microprocessor, a microcontroller, or any other type of electronic control circuit. In another embodiment, the control device 510 is a microcontroller including ROM memory for storing program and compressed audio data, as well as an audio processor for decompressing and outputting audio data. In response to input signals and its control program, control device 560 produces audio outputs through amplifier and speaker 540. In this example, the audio playback device may include the microcontroller, ROM memory, amplifier, and speaker.

FIG. 5B illustrates a schematic 570 of an electrical circuit to be used with a scanner 220 according to an embodiment of the invention. Schematic 570 includes a controller 570 connected with a output data port 580 for communicating with control device 510, a pressure switch 585, and an RF identification circuit 590. In one embodiment, the control device 575 is a microcontroller including ROM memory for storing program data. Control device 575 operates RF identification circuit 590 and communicates scanned identifications through the output data port 580.

Table 4 lists various audio responses that can be used with the shopping items listed in Table 1 and shown in FIG. 4(*b*), and with the shopping cart shown in FIG. 1. A figurine named "Tad" is sitting in the shopping cart. Lines 1 to 81 of the script describe the audio responses played in different operating modes according to the input received. The Appendices in Table 4, located at lines 95 to the end, provides details of the specific audio phrases associated with each of the shopping items in each operating mode. In the script of Table 4, a "/" character is used to subdivide audio phrases into segments. Segments can be reused by many different phrases. Segmenting phrases into reusable segments minimizes the amount of redundant audio information and, consequently, the memory storage required for the audio data.

As mentioned above, various play packs can be used with the shopping cart. After scanning something from an accessory pack, the toy will expand its data to include items from that pack. In Table 4, audio scripts for grocery food item play pack (i.e., a packout play pack) are described in detail. Audio scripts for other items including picnic and birthday theme packs are described in U.S. Provisional Patent Application No. 60/346,456, filed on Jan. 5, 2002, which is incorporated by reference herein for all purposes.

TABLE 4

| Line | Action/Prompt | Audio/Response |
|---|---|---|
| 1 | IN ANY MODE: | |
| 2 | Turn the unit on | Hi! / It's Tad! (then go to appropriate mode script) |
| 3 | Scanner reads code or hits something | See LED blinking. Hear beep (as written in script below) |
| 4 | | |
| 5 | EXPLORE MODE: | |
| 6 | Switch to this mode or press Tad to wake up | (Explore Intro Jingle) / Let's go shopping! |
| 7 | Press scanner to wake up | Go to appropriate line for scanning (either scannable toy item or not). Cycles through different facts, then starts at beginning again. |
| 8 | After first 10 seconds of inactivity | Let's go shopping! Scan a tag! |
| 9 | After second 10 seconds of inactivity | Scan a tag! |
| 10 | After third 10 seconds of inactivity | Thanks for learning! / Bye bye! |
| 11 | | |
| 12 | Scan scannable toy item first time | See Appendix. |
| 13 | Scan scannable toy item second time | See Appendix. |
| 14 | Scan scannable toy item third time | See Appendix. |
| 15 | First scan of a non-scannable toy item | See Appendix. |
| 16 | Subsequent scans of non-scannable items | See Appendix. |

TABLE 4-continued

| Line | Action/Prompt | Audio/Response |
|---|---|---|
| 17 | Press Tad | Play Shopping Song. |
| 18 | | |
| 19 | | |
| 20 | LEARN MODE: | |
| 21 | Switch to this mode or press Tad to wake up | (Intro Jingle) / Let's shop and learn! |
| 22 | Press scanner to wake up | Go to appropriate line for scanning (either scannable toy item or not) |
| 23 | After first 10 seconds of inactivity | Let's shop and learn! Scan a tag! |
| 24 | After second 10 seconds of inactivity | Scan a tag! |
| 25 | After third 10 seconds of inactivity | Thanks for learning! / Bye bye! |
| 26 | | |
| 27 | Scan a Packout Item | See Appendix. |
| 28 | Scan a Birthday Item | See Appendix. |
| 29 | Scan a Picnic item | See Appendix. |
| 30 | First scan of anon-scannable toy item | See Appendix. |
| 31 | Subsequent scans of non-scannable items | See Appendix. |
| 32 | Press Tad | Play shopping song. |
| 33 | | |
| 34 | GAME MODE: | |
| 35 | Switch to this mode or press Tad to wake up | (Game Intro jingle) (go to Prompt Line) |
| 36 | Prompt Line | Game prompt. See Appendix. Randomly select a prompt and randomly fill in items |
| 37 | Press scanner to wake up | (beep!) /Then go to Prompt Line |
| 38 | | |
| 39 | If LIST PROMPT given: | |
| 40 | After first 10 seconds of inactivity in List Prompt Game | We need (item name) / and / (item name)! (or whatever has not been correctly scanned in) |
| 41 | After second 10 seconds of inactivity | Scan a tag! |
| 42 | After third 10 seconds of inactivity | Thanks for learning ! / Bye bye! |
| 43 | | |
| 44 | Scan correct item | (beep!) / item name / (correct sfx) / (positive phrase) |
| 45 | If scanned item completes list, then says | (Completion Phrase) / Press me when you're ready to shop some more! / (GO TO "GAME OVER" STATUS) |
| 46 | Scan wrong scannable toy item first and second times in List Prompt Game (count starts over after each correct scan) | (beep!) (item name) / Oops! (giggle) / We need / (item name)/ and /(item name). (Toy lists items not yet scanned correctly.) (A clue given for one or more of the incorrectly scanned items.) |
| 47 | Scan wrong scannable toy item third time | (beep!) (item name) / Want to shop some more? / Press me!/ (GO TO "GAME OVER" STATUS) |
| 48 | Scan a non-scannable toy item first and second times in List Prompt Game (count starts over after each correct scan) | (beep!) We're buying lots of things! / We need / (item name)/ and /(item name). (Toy lists items not yet scanned correctly.) (A clue given for one or more of the items incorrectly scanned items.) |
| 49 | Scan a non-scannable toy item third time | (beep!) We're buying lots of things! /Press me when you're ready to shop some more! (GO TO "GAME OVER" STATUS) |
| 50 | Press Tad first or second time before scanning all correct items in List Prompt Game (count starts over after each correct scan) | My list says/ we need / (item name)/ and /item name). (Toy lists items not yet scanned correctly.) (A clue is given for one of the items not yet scanned correctly). |
| 51 | Press Tad third time before scanning all correct items | Press me when you're ready to shop some more! |
| 52 | "GAME OVER" STATUS - functions as in Explore Mode, except if Tad pressed, which starts a new game. | |
| 53 | Press Tad in "GAME OVER" STATUS | go to Prompt Line |
| 54 | Reminder Prompt: after first 10 seconds with Tad not being pressed in GAME OVER STATUS (this is not an inactivity prompt - this is a reminder prompt to play the game. So only refers to TAD not being pressed) | Want to shop some more? Press me! |
| 55 | Reminder Prompt #2: after second 10 seconds with Tad not being pressed GAME OVER STATUS | Press me when you're read to shop some more! |
| 56 | STATUS: Inactivity Prompt in GAME OVER | |
| 57 | After first 10 seconds of inactivity | Want to shop some more? Press me |
| 58 | After second 10 seconds of inactivity | Press me when you're ready to shop some more! |
| 59 | After third 10 seconds of inactivity | Thanks for learning! / Bye bye! |
| 60 | | |

TABLE 4-continued

| Line | Action/Prompt | Audio/Response |
|---|---|---|
| 61 | If MYSTERY PROMPT given: | |
| 62 | After first 10 seconds of inactivity in Mystery Prompt Game | Repeats Prompt |
| 63 | After second 10 seconds of inactivity | Scan a tag! |
| 64 | After third 10 seconds of inactivity | Thanks for learning! / Bye bye! |
| 65 | | |
| 66 | Scan correct item | (beep!) /(item name) /(correct sfx) / (positive phrase) |
| 67 | If scanned item completes list, then says: | (Completion Phrase) / Press me when you're ready to shop some more! (GO TO "GAME OVER" STATUS) |
| 68 | Scan wrong scannable toy item first and second times in Mystery Prompt Game | (beep!) (item name) /Oops! (giggle) / (appropriate clue for the item) |
| 69 | Scan wrong scannable toy item third time | (beep!) (item name) / Want to shop some more? / Press me!/ (GO TO "GAME OVER" STATUS) |
| 70 | Scan a non-scannable toy item first and second times in Mystery Prompt Game | (beep!) We're buying lots of things! / (appropriate clue for the item) |
| 71 | Scan a non-scannable toy item third time | (beep!) We're buying lots of things! /Press me when you're ready to shop some more! (GO TO "GAME OVER" STATUS) |
| 72 | Press Tad first or second time before scanning all correct items in Mystery Prompt Game | (appropriate clue for the item) |
| 73 | Press Tad third time before scanning all correct items | Press me when you're ready to shop some more! |
| 74 | "GAME OVER" STATUS - functions as in Explore Mode, except if Tad pressed, which starts a new game. | |
| 75 | Press Tad in "GAME OVER" STATUS go to Prompt Line | |
| 76 | Reminder Prompt: after first 10 seconds with Tad not being pressed in GAME OVER STATUS (this is not an Inactivity prompt - this is a reminder prompt to play the game. So only refers to Tad not being pressed ) | Want to shop some more? Press me! |
| 77 | Reminder Prompt #2: after second 10 seconds with Tad not being pressed in GAME OVER STATUS | Press me when you're ready to shop some more! |
| 78 | Inactivity Prompt in GAME OVER STATUS: | |
| 79 | After first 10 seconds of inactivity. | Want to shop some more? Press me! |
| 80 | After second 10 seconds of Inactivity | Press me when you're ready to shop some more! |
| 81 | After third 10 seconds of inactivity | Thanks for learning! / Bye bye! |
| 82–94 | Reserved for music and sound effects | |
| 95 | PACKOUT APPENDIX | |
| 96 | APPENDIX PACKOUT-A | |
| 97 | EXPLORE MODE SCANNING | |
| 98 | Item Name/ scan number Audio Response | |
| 99 | Milk - first scan | (beep) One / carton of / white \| milk! / (Tad expression) |
| 100 | Milk - second scan | (beep) Milk! / This / milk / comes from a / cowl / Did you know that/ milk/ from a yak is / pink! (Giggle) |
| 101 | Milk - third scan | (beep) Milk! Milk /has lots of / calcium! |
| 102 | Milk - fourth scan | (beep) Milk! / You build strong / bones/ by drinking/ milk! |
| 103 | Pork Chops - first scan | (beep) two / pink / pork chops! / (Tad Expression) |
| 104 | Pork Chops - second scan | (beep) pork chops! / Pork chops / ham, and bacon all come from a/ pig! |
| 105 | Pork Chops - third scan | (beep) pork chops! / Pork chops / have lots of / protein! |
| 106 | Pork Chops - fourth scan | (beep) pork chops! / You build strong / muscles / by eating /Pork Chops! |
| 107 | Bananas - first scan | (beep) Three / yellow / bananas! (Tad Expression) |
| 108 | Bananas - second scan | (beep) Bananas! / Bananas / grow on plants / that can be as tall as a two story house! |
| 109 | Bananas - third scan | (beep) Bananas! / Bananas / are / fruit! / and there fun to eat! |
| 110 | Bananas - fourth scan | (beep) Bananas / are good for your / muscles! / Especially / when you're exercising! |
| 111 | Carrots - first scan | (beep) Four / orange / carrots!/ ad expression) |
| 112 | Carrots - second scan | (beep) carrots! / Carrots \| make good noses for snowmen! |
| 113 | Carrots - third scan | (beep carrots! / carrots / are / a vegetable) |
| 114 | Carrots - fourth scan | (bee) carrots / help you see / especially / at night |
| 115 | Cereal - first scan | (beep) Five / blue/ boxes of / cereal! (Tad expression) |
| 116 | Cereal - second scan | (beep) Cereal! \| Sometimes I like to eat my \| cereal / with / milk: / Sometimes I like to eat my \| cereal / plain. /How about you? |
| 117 | Cereal - third scan | (beep) Cereal! / Cereal / is / a grain! |
| 118 | Cereal - fourth scan | (beep) Cereal / gives you energy! |
| 119 | Eggs - first scan | (beep) Six / white / eggs! (Tad expression) |
| 120 | Eggs - second scan | (beep) Eggs! / Most / eggs / are / white!/ But some/ are / brown / or / blue / or / green! / Wow! |

TABLE 4-continued

| Line | Action/Prompt | Audio/Response |
|---|---|---|
| 121 | Eggs - third scan | (beep) Eggs! / Eggs /have lots of / protein! |
| 122 | Eggs - fourth scan | (beep) Eggs /You build strong / muscles / by eating / eggs! |
| 123 | cherries - first scan | (beep) Seven / red / cherries! (Tad expression) |
| 124 | cherries - second scan | (beep) Cherries! /Cherries / have pits inside. / Pits are big seeds. / Wow! |
| 125 | cherries - third scan | (beep) Cherries! /Cherries / are / fruit! |
| 126 | cherries - fourth scan | (beep) Cherries /help owees and cuts get better fast! |
| 127 | muffins - first scan | (beep) Eight / brown /muffins! (Tad expression) |
| 128 | muffins - second scan | (beep) Muffins! / Bran / muffins / are my favorite! / yummy ! |
| 129 | muffins - third scan | (beep) Muffins! /Muffins / are / a grain! |
| 130 | muffins - fourth scan | (beep) Muffins / give you energy! |
| 131 | peas - first scan | (beep)Nine / green / peas! (Tad expression) |
| 132 | peas - second scan | (beep) Peas. / Peas / grow / in a pod. / There are usually / 3 / peas/ in a pod. |
| 133 | peas - third scan | (beep) Peas \| /Peas / are / a vegetable! |
| 134 | peas - fourth scan | (beep) Peas /help owees and cuts get better fast! |
| 135 | strawberries - -first scan | (beep) Ten / red / strawberries! (Tad expression) |
| 136 | strawberries - second scan | (beep) Strawberries / Strawberries/ have 200 seeds on the outside! Wow! |
| 137 | strawberries - third scan | (beep) Strawberries! /Strawberries / are / fruit! |
| 138 | strawberries - fourth scan | (beep) Strawberries /help owees and cuts get better fast! |
| 139 | | |
| 140 | APPENDIX PACKOUT-B | |
| 141 | TAD EXPRESSIONS FOR EXPLORE MODE | |
| 142 | "I like /(item name)!" | |
| 143 | "I'm glad we're buying \| (item name)!" | |
| 144 | "Yumm!" | |
| 145 | giggle | |
| 146 | | |
| 147 | | |
| 148 | APPENDIX PACKOUT-C | |
| 149 | EXPLORE AND LEARN MODE NON-SCANNABLE TOY ITEMS | |
| 150 | Plays one of the following randomly: | (beep) Good choice! |
| 151 | | (beep) Will it fit in the cart? |
| 152 | | (beep) Let's get it! |
| 153 | | (beep All right! |
| 154 | | (beep) Super! |
| 155 | | |
| 156 | | |
| 157 | APPENDIX PACKOUT-D | |
| 158 | LEARN MODE SCANS | |
| 159 | Item Name/scan number | Audio Response (counting will be done to background tune) |
| 160 | Cartons of / milk - first scan | (beep) One / carton of / milk! / (pause) / one! / (positive phrase) |
| 161 | Cartons of / milk - second scan | (beep) milk! / We only have / one/ carton of / milk. |
| 162 | pork chops - first scan | (beep) Two / pork chops! / Let's count to /two! / (pause) \| one! / two / (positive phrase) |
| 163 | pork chops second scan (if greater quantity has been scanned just before) | (beep) Two \| pork chops! / we have / fewer / pork chops/ than / (item name scanned just before) |
| 164 | pork chops second scan (if smaller quantity has been scanned just before) | (beep) Two / pork chops! / we have / more / pork chops/ than / (item name scanned just before) |
| 165 | pork chops second scan | (beep) Two / pork chops! one / for you and /one / for me! |
| 166 | Bananas - first scan | (beep) Three / bananas! / Let's count to / three! / (pause) \| one / two / three/ (positive phrase) |
| 167 | Bananas - second scan (if greater quantity has been scanned just before) | (beep) Three / bananas! / we have / fewer / bananas / than / (item name scanned just before) |
| 168 | Bananas - second scan (if smaller quantity has been scanned just before) | (beep) Three / bananas! / we have \| more / bananas / than / (item name scanned just before) |
| 169 | Bananas - second scan | (beep) Three / bananas! / we have / fewer / bananas / than / (higher quantity item name) |
| 170 | Carrots - first scan | (beep) Four/ carrots! / Let's count to / four! / (pause) / one / two \| three / four/ (positive phrase) |
| 171 | Carrots - second scan (!f greater quantity has been scanned just before) | (beep) Four / carrots! / we have / fewer / carrots / than / (item name scanned just before) |
| 172 | Carrots - second scan (if smaller quantity has been scanned just before) | (beep) Four / carrots! / we have / more / carrots / than / (item name scanned just before) |
| 173 | carrots - second scan | (beep) Four / carrots! / Two/ for you and /Two / for me! |

TABLE 4-continued

| Line | Action/Prompt | Audio/Response |
|---|---|---|
| 174 | Boxes of cereal - first scan | (beep) Five / boxes of / cereal! / Let's count to / five! / (pause) / one / two / three / four/ five /(positive phrase) |
| 175 | Boxes of cereal - second scan (if greater quantity has been scanned just before | (beep) five / boxes of / cereal! / we have / fewer / boxes of / cereal / than / (item name scanned just before) |
| 176 | Boxes of cereal - second scan (if smaller quantity has been scanned just before) | (beep) five / boxes of / cereal! / we have / more / boxes of / cereal / than / (item name scanned just before) |
| 177 | Boxes of cereal - second scan | (beep) five \| boxes of /cereal! / we have / more / boxes of / cereal \| than \| (lesser quantity item name) |
| 178 | Eggs | (beep) Six / eggs! / Let's count to / six! / (pause) / one / two / three / four/ five / six / (positive phrase) |
| 179 | eggs - second scan (if greater quantity has been scanned just before) | (beep) six \| eggs! / we have / fewer / eggs / than / (item name scanned just before) |
| 180 | eggs - second scan (if smaller quantity has been scanned just before) | (beep) six eggs! / we have / more / eggs / than / (item name scanned just before) |
| 181 | eggs - second scan | (beep) six / eggs! / Three / for you and / three / for me! |
| 182 | cherries | (beep) Seven / cherries! / Let's count to / seven! / (pause) / one / two / three / four/ five / six / seven /(positive phrase) |
| 183 | cherries - second scan (if greater quantity has been scanned just before) | (beep) seven / cherries! /we have / fewer / cherries than / (item name scanned just before) |
| 184 | cherries - second scan (if smaller quantity has been scanned just before) | (beep) seven / cherries! / we have / more / cherries / than / (item name scanned just before) |
| 185 | cherries - second scan (if nothing or Birthday Pack item has been scanned just before) | (beep) seven / cherries! / we have / more / cherries / than / (lesser quantity item name) |
| 186 | muffins | (beep) Eight / muffins! / Let's count to / eight! / (pause) / one / two / three / four / five / six / seven / eight / (positive phrase). |
| 187 | muffins - second scan (if greater quantity has been scanned just before) | (beep) eight / muffins! / we have / fewer / muffins / than / (item name scanned just before) |
| 188 | muffins - second scan (if smaller quantity has been scanned just before) | (beep) eight \| muffins! / we have / more / muffins / than / (item name scanned just before) |
| 189 | muffins - second scan (if nothing or Birthday Pack Item has been scanned just before) | (beep) eight / muffins! / Four / for you and / four / for me! |
| 190 | peas | (beep) Nine / peas! Let's count to / nine! / (pause) / one / two / three / four/ five / six / seven / eight / nine / (positive phrase) |
| 191 | peas - second scan (if greater quantity has been scanned just before) | (beep) nine / peas! / we have / fewer / peas / than / (item name scanned just before) |
| 192 | peas - second scan (if smaller quantity has been scanned just before) | (beep) nine / peas! / we have / more / peas / than / (item name scanned just before) |
| 193 | peas - second scan | (beep) nine / peas! / we have / more / peas / than / (lesser quantity item name) |
| 194 | strawberries | (beep) Ten / strawberries! / Let's count to / ten! / (pause) / one / two / three / four/ five / six / seven / eight / nine / ten / (positive phrase) |
| 195 | strawberries - second scan (if greater quantity has been scanned just before) | (beep) ten / strawberries! / we have / fewer / strawberries / than / (item name scanned just before) |
| 196 | strawberries - second scan (if smaller quantity has been scanned just before) | (beep) ten / strawberries! / we have / more / strawberries / than / (item name scanned just before) |
| 197 | strawberries - second scan | (beep) ten / strawberries! / Five / for you and /five / for me! |
| 198 | | |
| 199 | | |
| 200 | Appendix PACKOUT-E | |
| 201 | Learn Mode Positive Phrases | |
| 202 | Yeah! | |
| 203 | all right! | |
| 204 | great! | |
| 205 | super! | |
| 206 | I like / counting to / (quantity of last item scanned)! | |
| 207 | | |
| 208 | | |
| 209 | Appendix PACKOUT-F | |
| 210 | Game Mode Prompts and Completion Phrases | |

TABLE 4-continued

| Line | Action/Prompt | Audio/Response | |
|---|---|---|---|
| 211 | Random selected prompts. | Randomly selects items to insert into prompt: | Completion Phrases |
| 212 | LIST PROMPTS: | | |
| 213 | Let's make \| a fruit shake! / My list says / we need / (item name) / and /(item name) | bananas, cherries, strawberries | Now we have everything to make /a fruit shake! / It's going to be delicious! |
| 214 | Let's make breakfast, I need / (item name) and / (item name) | milk, bananas, cereal, eggs, muffins, strawberries | Now we have everything to make breakfast! / I can hardly wait to eat! |
| 215 | Let's make /dinner! / My list says we need (item name) and (item name) | milk, pork chops, carrots, cherries, peas, and strawberries | Now we have everything to make dinner! / It's going to be delicious! |
| 216 | Let's make /a snack! / My list says we need (item name) and (item name) | milk, bananas, carrots, cherries, peas, and strawberries | Now we have everything to make a snack! / I can hardly wait to eat! |
| 217 | Let's buy / vegetables! / My list says we need (item name) and (item name) | carrots, peas | We bought a lot of vegetables! |
| 218 | Let's buy / fruit! \| My list says \| we need / (item name) /and /(item name) | bananas, cherries, strawberries | We bought a lot of fruit! |
| 219 | Let's buy / white/ things!" | milk, eggs | We bought a lot of / white / things! |
| 220 | Lets buy / red/ things !" | cherries, strawberries | We bought a lot of / red / things! |
| 221 | MYSTERY PROMPTS and CLUES: | | |
| 222 | Milk: | | |
| 223 | I forgot to buy / something. Can you help me? It / comes from a / cow | answer - milk | Thank you! / That's what I forgot! / milk! |
| 224 | first clue: I forgot to buy / something / white! | | |
| 225 | second clue: I forgot to buy / milk! | | |
| 226 | Pork Chops: | | |
| 227 | 1 forgot to buy / something. Can you help me? It / comes from a pig! | answer - pork chops | Thank you! / That's what I forgot! /pork chops |
| 228 | first clue: I forgot to buy / something / pink! | | |
| 229 | second clue: I forgot to buy / pork chops! | | |
| 230 | Bananas: | | |
| 231 | 1 forgot to buy / something. Can you help me? They / grow on plants! | answer - bananas | Thank you! / That's what I forgot! / bananas |
| 232 | first clue: I forgot to buy / something / yellow | | |
| 233 | second clue: I forgot to buy / bananas | | |
| 234 | Carrots: | | |
| 235 | I forgot to buy / something. Can you help me? They / make good noses for snowmen! | answer - carrots | Thank you! / That's what I forgot! / carrots |
| 236 | first clue: I forgot to buy / something / orange | | |
| 237 | second clue: I forgot to buy / carrots | | |
| 238 | Cereal: | | |
| 239 | I forgot to buy / something. Can you help me? It / is / a grain! | answer - cereal | Thank you! / That's what I forgot!/ cereal |
| 240 | first clue: I forgot to buy / something / blue | | |
| 241 | second clue: I forgot to buy / cereal | | |
| 242 | Eggs: | | |
| 243 | I forgot to buy / something. Can you help me? They / have lots of / protein! | answer-eggs | Thank you! /That's what I forgot! /eggs |
| 244 | first clue: I forgot to buy / something / white! | | |
| 245 | second clue: I forgot to buy /eggs | | |
| 246 | Cherries: | | |
| 247 | I forgot to buy / something. Can you help me? They / have pits inside! | answer - cherries | Thank you! / That's what I forgot! / cherries |
| 248 | first clue: I forgot to buy / something /red | | |
| 249 | second clue: I forgot to buy /cherries | | |
| 250 | Muffins: | | |
| 251 | I forgot to buy / something. Can you help me? They / give you energy ! | answer-muffins | Thank you! / That's what I forgot /muffins |
| 252 | first clue: I forgot to buy / something /brown | | |

TABLE 4-continued

| Line | Action/Prompt | Audio/Response | |
|---|---|---|---|
| 253 | second clue: I forgot to buy /muffins | | |
| 254 | Peas: | | |
| 255 | I forgot to buy / something. Can you help me? The / grow in a pod! | answer -peas | Thank you! / That's what I forgot! / peas |
| 256 | first clue: I forgot to buy / something /green | | |
| 257 | second clue: I forgot to buy /peas | | |
| 258 | Strawberries: | | |
| 259 | I forgot to buy / something. Can you help me? They / have 200 seeds on the outside! | answer-strawberries | Thank you / That's what I forgot / strawberries |
| 260 | first clue: I forgot to buy / something / red | | |
| 261 | second clue: I forgot to buy / strawberries | | |
| 262 | | | |
| 263 | | | |
| 264 | APPENDIX PACKOUT-G | | |
| 265 | GAME MODE POSITIVE PHRASES | | |
| 266 | yeah | | |
| 267 | alright | | |
| 268 | great | | |
| 269 | super | | |
| 270 | | | |
| 271 | APPENDIX PACKOUT-H | | |
| 272 | GAME MODE. ITEM NAMES AND LIST PROMPT CLUES | | |
| 273 | Item Name | Clue | |
| 274 | milk | The / milk/ carton is / white | |
| 275 | pork chops | The / pork chops / are / pink | |
| 276 | bananas | The / bananas / are / yellow | |
| 277 | carrots | The / carrots / are /orange | |
| 278 | cereal | The \| boxes of / cereal / are / blue | |
| 279 | eggs | The / eggs / are / white | |
| 280 | cherries | the / cherries / are / red | |
| 281 | muffins | The / muffins / are / brown | |
| 282 | peas | The / peas / are / green | |
| 283 | strawberries | The / strawberries / are / red | |

Figure 6:
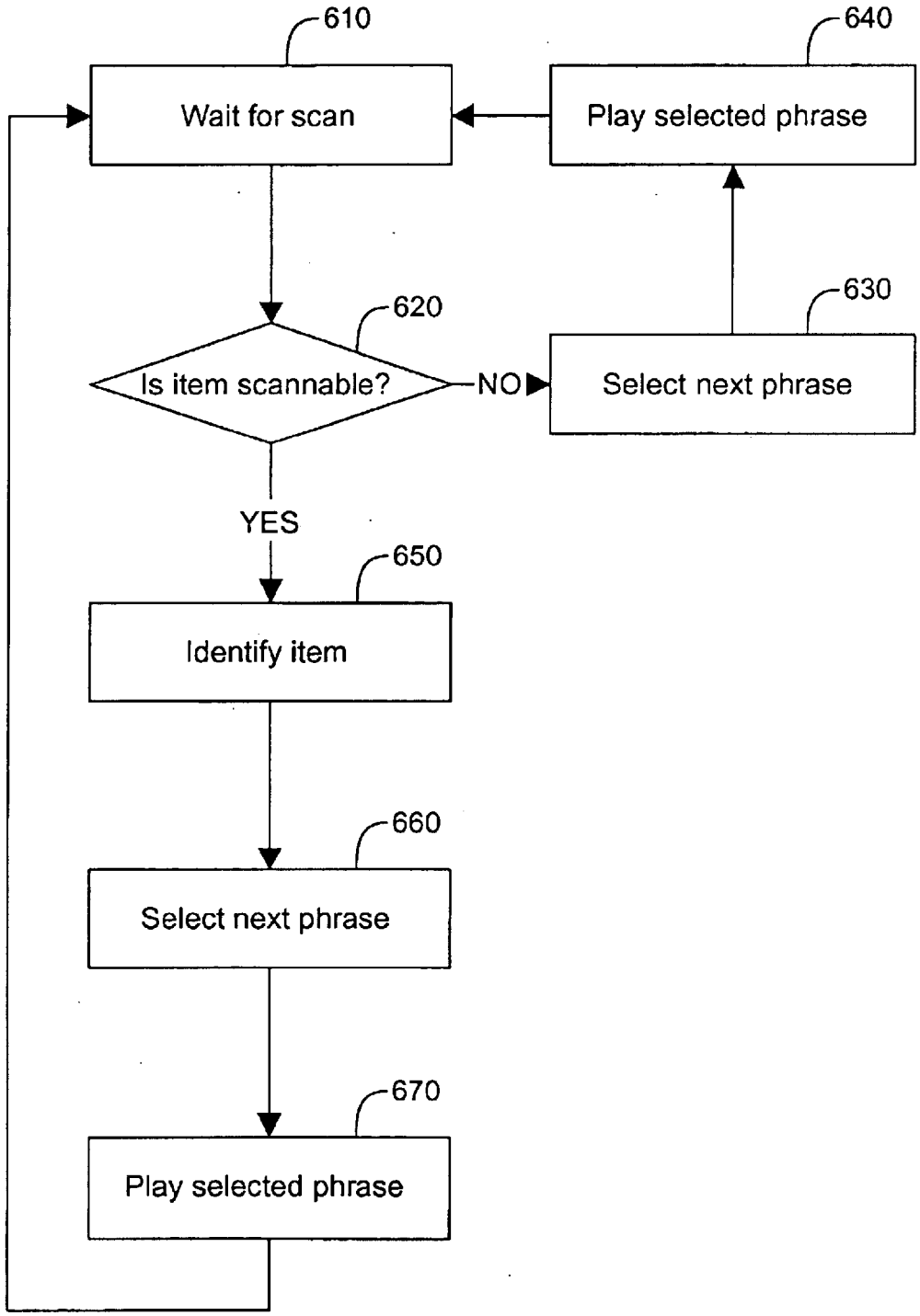
FIG. 6 illustrates a flowchart of a first mode of operation for an embodiment of an interactive shopping role-play toy.

FIG. 6 illustrates a flowchart 600 of an exploration mode of operation for the shopping cart 100. In exploration mode, a child can learn facts about shopping items. The shopping cart 100 recites the name of a shopping item the first time it is scanned. The shopping cart 100 recites additional information about a shopping item upon subsequent scans. Table 4 contains an example script specifying the audio output in response to input. Lines 5 to 17 of the script in Table 4 further specify the audio responses for the exploration mode illustrated by flowchart 600.

At step 610, the shopping cart 100 waits for an object to be scanned by scanner 220. Once an item has been scanned, at step 620 the shopping cart 100 determines whether the scanned item is shopping item containing an electronic identification, or a non-scannable toy item. A non-scannable toy item is any object not containing an RF identification tag configured for scanner 220. In step 620, a non-scannable toy item is detected when the pressure switch 310 on scanner 220 is activated without simultaneous reception of a response signal by RF identification unit 305. Shopping items are detected when RF identification unit 305 receives a response signal from an RF identification tag.

After scanning a scannable toy item, step 650 identifies the scanned shopping item. In one embodiment, the shopping item is identified by the unique response signal emitted by the identification tag embedded in a shopping item. Step 660 selects one of a plurality of phrases to be played for the shopping item. Lines 97 to 138 of the script in Table 4 list example audio responses for each shopping item. In this embodiment, there are four unique audio phrases associated with each shopping item. In a further embodiment, step 660 selects each of the audio phrases associated with a shopping item sequentially. Following the selection of the final audio phrase associated with a shopping item, a subsequent scan of the same item will result in the selection of the first audio phrase. Step 670 outputs the selected audio response. Following completion of step 670, step 610 waits for the next scan.

In response to a non-scannable toy item, step 630 selects a phrase to be played for non-scannable toy items. A plurality of example phrases associated with non-scannable toy items is listed at lines 149 to 154 of the script in Table 4. In this example, the audio response for non-scannable toy items is designed to be appropriate for an unknown object and encourage further play with the shopping cart 100. Phrases are selected randomly at step 630. Step 640 outputs the selected audio response. After completing step 640, step 610 waits for the next scan.

The interactive responses for non-scannable toy items allow a child to incorporate other objects, such as a favorite toy or a pet dog, into their use of shopping cart 100. Additionally functionality in exploration mode includes the playing of a shopping song when the character switch 210 is activated.

Figure 7:
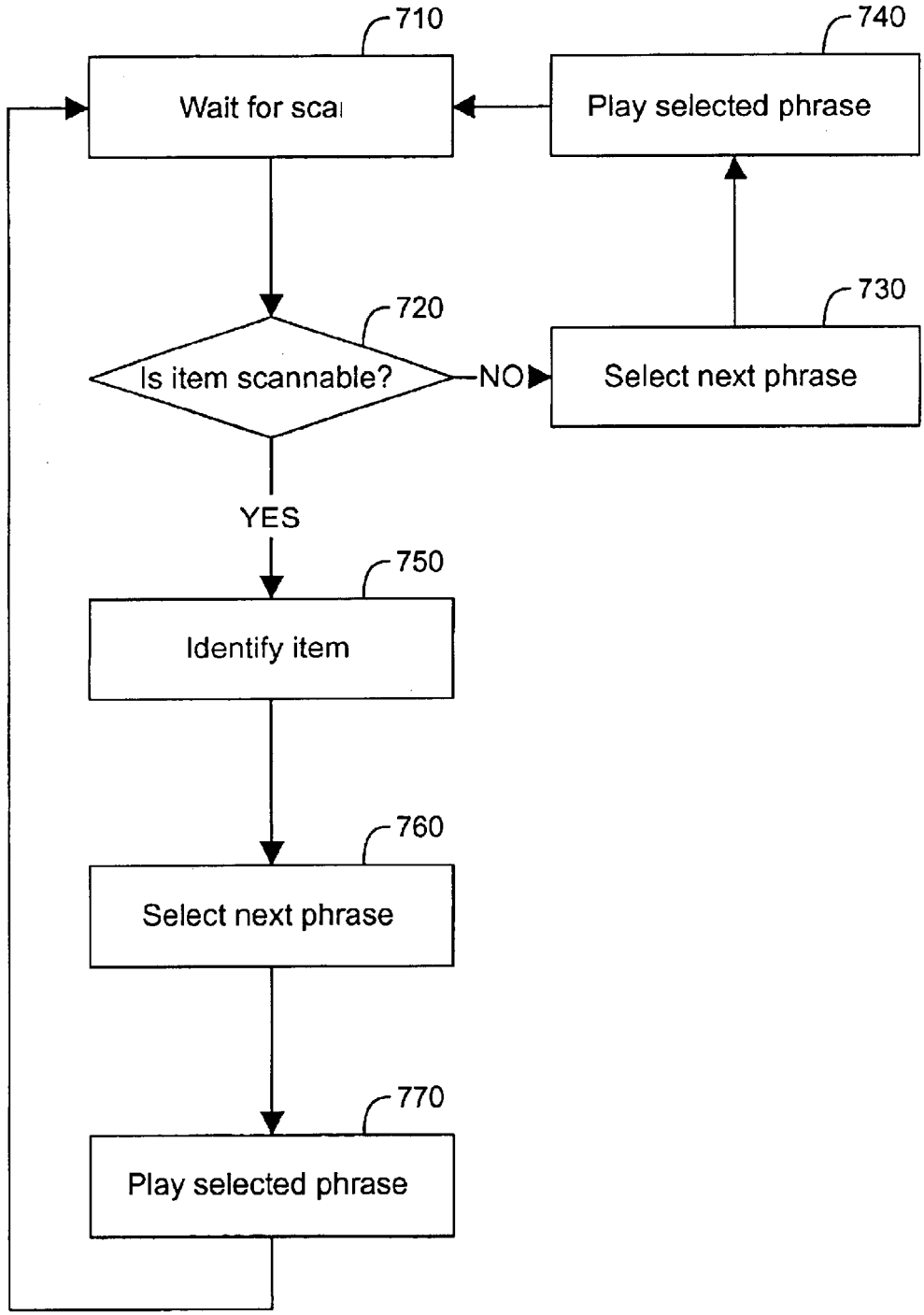
FIG. 7 illustrates a flowchart of a second mode of operation for an embodiment of an interactive shopping role-play toy.

FIG. 7 illustrates a flowchart 700 of a learning mode of operation for the shopping cart 100. An embodiment of the learning mode teaches counting, numbers, and the relationships between numbers and quantities. In this embodiment, each shopping item is associated with a quantity and a number. Lines 20 to 32 of the script in Table 1 further specify the audio responses for the learning mode illustrated by flowchart 700.

At step 710, the shopping cart 100 waits for an object to be scanned by scanner 220. Once an item has been scanned, at step 720 the shopping cart 100 determines whether the scanned item is a shopping item containing an electronic identification, or a non-scannable toy item. A non-scannable toy item is any object not containing an RF identification tag configured for scanner 220. In step 720, a non-scannable toy item is detected when the pressure switch 310 on scanner 220 is activated without simultaneous reception of a response signal by RF identification unit 305. Shopping items are detected when RF identification unit 305 receives a response signal from an RF identification tag.

In response to a scannable toy item, step 750 identifies the scanned shopping item. In some embodiments, the shopping item is identified by the unique response signal emitted by the identification tag embedded in a shopping item. Step 760 selects one of a plurality of phrases to be played for the shopping item. Lines 158 to 197 of the script in Table 4 list example audio responses for each shopping item. In this embodiment, there are four unique audio phrases associated with each shopping item. The first phrase associated with each shopping item identifies the scanned item and the numeric quantity associated with the item. The phrase also counts up to the number associated with the shopping item to reinforce the numerical relationships and to teach counting skills. The second phrase associated with a scanned item relates the quantity of the shopping item to the quantity of the previous shopping item. One of a set of alternate phrases is selected based on whether the scanned shopping item is greater than or less than the previously scanned shopping item.

Step 760 selects each of the audio phrases associated with a shopping item sequentially. Following the selection of the final audio phrase associated with a shopping item, a subsequent scan of the same item will result in the selection of the first audio phrase. Step 770 outputs the selected audio response. Following completion of step 770, step 710 waits for the next scan.

In response to a non-scannable toy item, step 730 selects a phrase to be played for non-scannable toy items. A plurality of example phrases associated with non-scannable toy items is listed at lines 149 to 154 of the script in Table 4. In this example, the audio response for non-scannable toy items is designed to be appropriate for an unknown object and encourage further play with the shopping cart 100. Phrases are selected randomly at step 730. Step 740 outputs the selected audio response. Following completion of step 740, step 710 waits for the next scan.

Figure 8A:
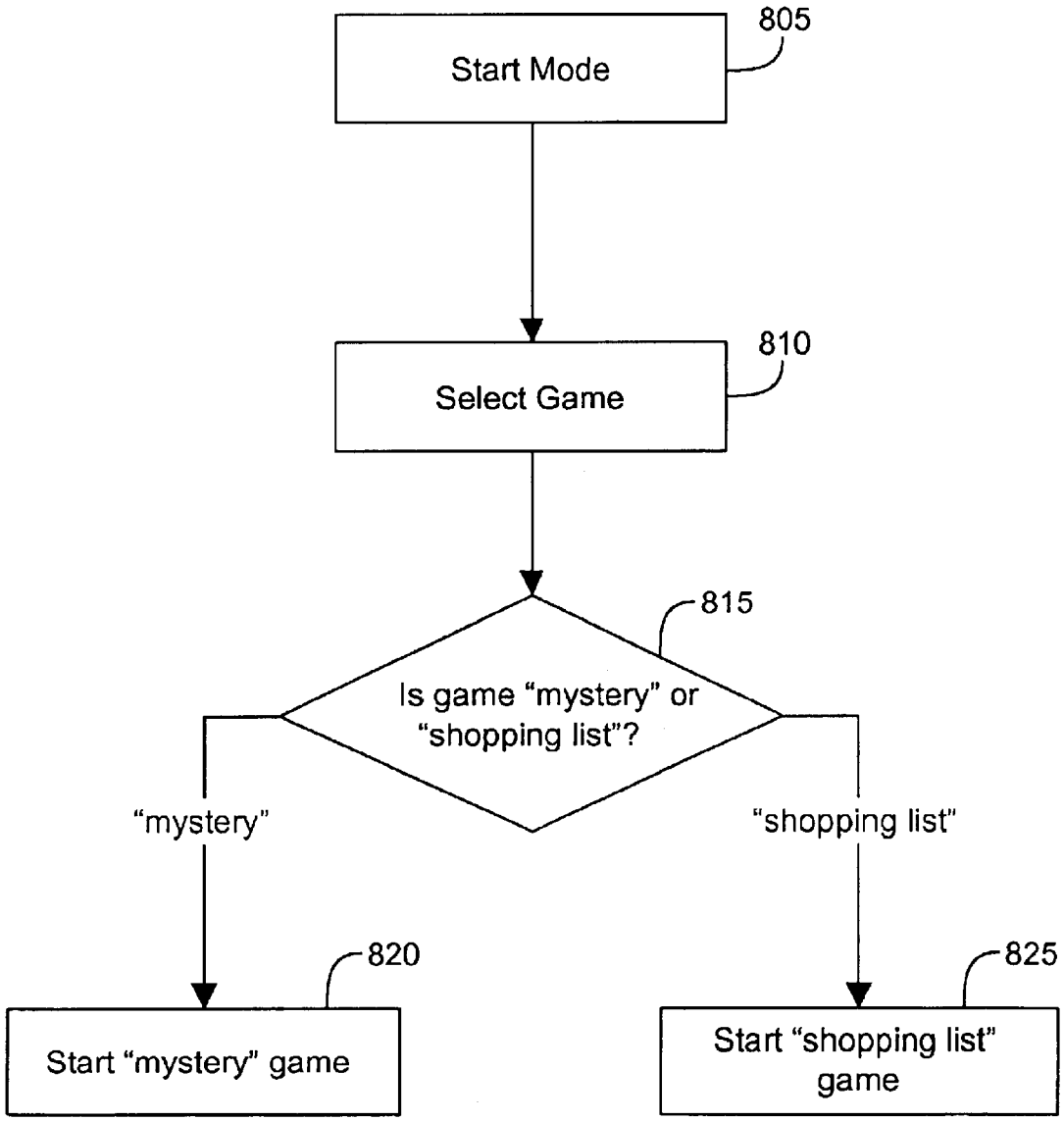
FIGS. 8A, 8B, and 8C illustrate flowcharts of a third mode of operation for an embodiment of an interactive shopping role-play toy.
Figure 8B:
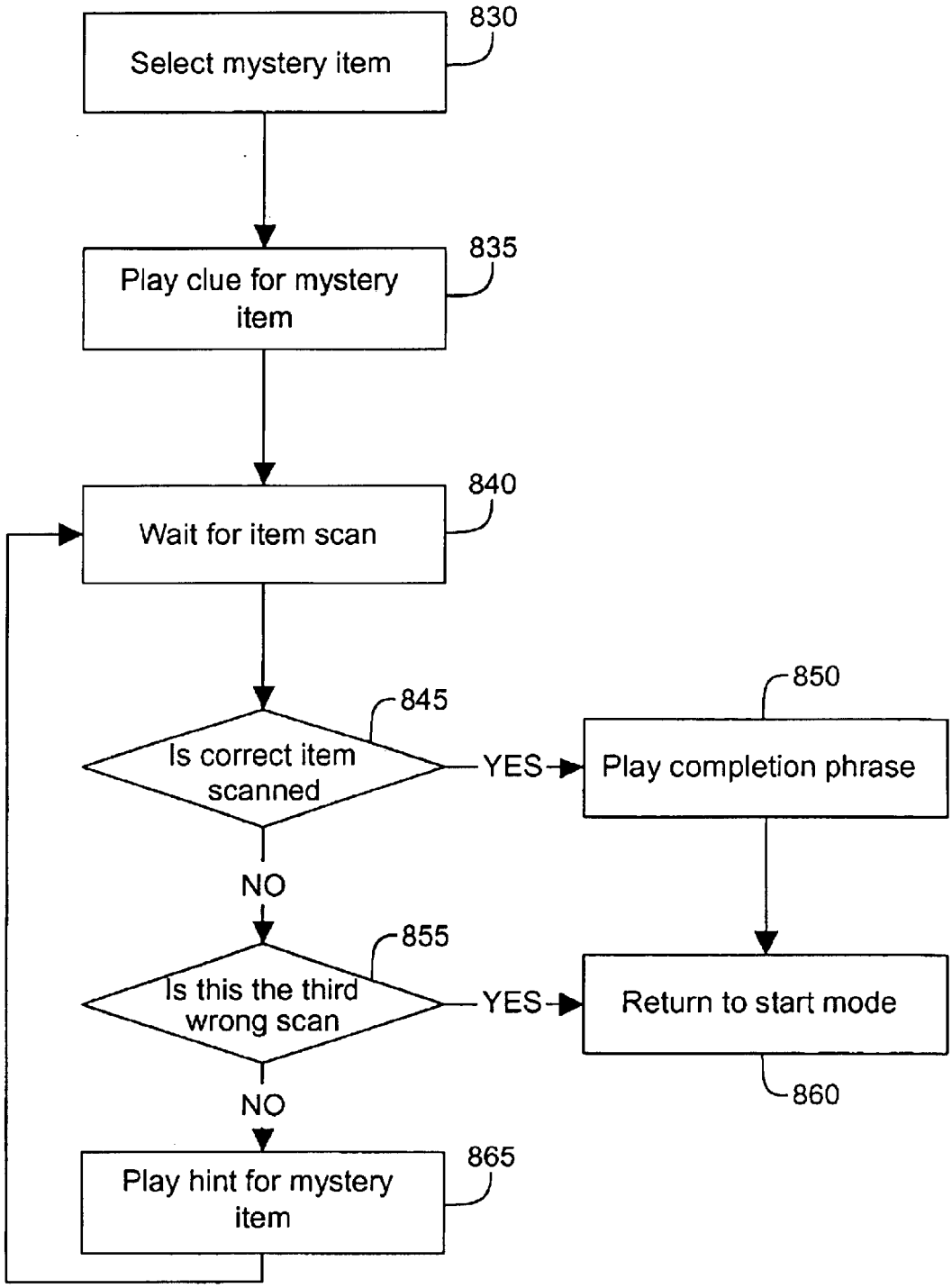
Figure 8C:
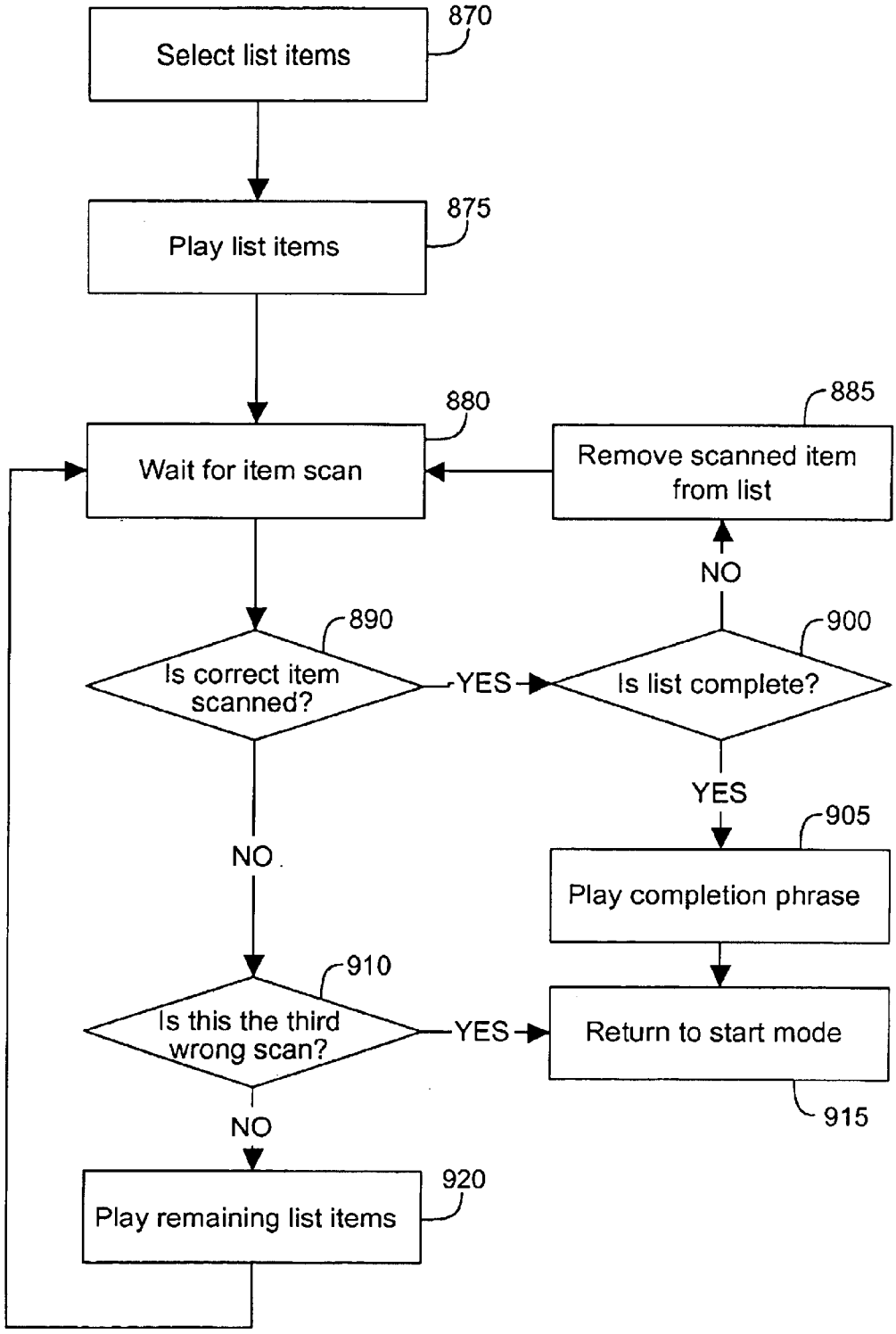

FIGS. 8A, 8B, and 8C illustrate flowcharts of a game mode of operation for an embodiment of an interactive shopping role-play toy. An embodiment of the game mode presents two different shopping theme games designed to reinforce the information learned from the other two modes. A first shopping game of an embodiment of the game mode is a "mystery" game in which the child is asked to scan an item identified by one or more clues. The clues can be based on information taught in the other operating modes. A second shopping game of an embodiment of the game mode is a "shopping list" game in which a child is asked to scan several items as part of a "shopping list." Lines 34 to 81 of the script in Table 4 further specify the audio responses for the game mode.

In FIG. 8A, at step 805, the game mode is started. The game mode is started either by initially moving the mode switch 215 into the game mode position, or by activating character switch 210 when mode switch 215 is already in the game mode position. At step 810, one of the games of the game mode is selected. This selection can be random. Step 815 identifies the game selection and in response, the mystery game or the shopping list game is started at step 820 or 825, respectively.

FIG. 8B illustrates a flowchart of the mystery game. Lines 221 to 271 of the script in Table 4 further specify the audio responses for the mystery game mode. At step 830, a mystery item is selected. This selection can be random. Based on the mystery item selected, step 835 plays a clue associated with the mystery item. Step 840 waits for an item to be scanned. If nothing is scanned after a predetermined amount of time, one or more phrases may be played to prompt the user. Further periods of inactivity may result in returning the start mode 805.

Once an item has been scanned, step 845 identifies the scanned shopping item and determines if it matches the selected mystery item. If the correct item has been scanned, a completion phrase is played at step 850 and the game returns to start mode 805. If the incorrect item is scanned, step 855 determines whether this is the third incorrect scan of the game. If three incorrect scans are made, step 860 returns to start mode 805. If this is the first or second incorrect scan, step 865 selects and plays a hint as indicated in Table 4, and returns to step 840 to wait for the next scanned item.

FIG. 8C illustrates a flowchart of the shopping list game. Lines 210 to 261 of the script in Table 4 further specify the audio responses for the shopping list game mode. At step 870, a pair of shopping list items are selected and added to a shopping list. This selection can be random. Based on the shopping list items selected, step 875 plays a phrase requesting the selected shopping items. Step 880 waits for an item to be scanned. If nothing, is scanned after a predetermined amount of time, one or more phrases may be played to prompt the user. Further periods of inactivity may result in returning the start mode 805.

Once an item has been scanned, step 890 identifies the scanned shopping item and determines if it matches one of the items on the items on the shopping list. If a correct item has been scanned, step 900 determines whether all of the items on the shopping list have been scanned. If the shopping list is not complete, step 885 removes the scanned item from the shopping list and returns to step 880 to await a subsequent scan. If all of the items on the shopping list have been scanned, a completion phrase is played at step 905 and step 915 returns the game to start mode 805.

If the incorrect item is scanned, step 910 determines whether this is the third incorrect scan of the game. If three incorrect scans are made, step 915 returns to start mode 805. If this is the first or second incorrect scan, step 90 plays the remaining shopping items on the list as a hint, and returns to step 880 to wait for the next scanned item.

As noted above, The interactive shopping role-play toy can optionally be expanded through the use of separately purchased expansion sets of additional shopping items. Each expansion set of shopping items has a unique set of RF identification tags that distinguish the expansion set from the shopping items included with the interactive shopping role-play toy. A set of unique phrases can be associated with the expansion set. The phrases can be preprogrammed into the interactive shopping role-play toy. Alternatively, additional phrases may be added through the use of a slot (which may be associated with a data input device) for an information storage medium, as discussed below.

The interactive toy can optionally include a slot (not shown) for a transferable information storage medium (not shown) that is operatively coupled to the processor and memory unit. The slot can be cooperatively structured to receive the transferable storage medium in a removable manner. Any suitable transferable storage medium can be employed in the toy including, but not limited to, a data cartridge (e.g., a flash memory cartridge), a disk, a tape or a memory stick. The transferable information storage medium can be used to provide code for new operating modes or new audio data (e.g., new phrases or songs) to the toy. The transferable information storage medium may be purchased at a store, or may be created at the user's site by downloading new content from a personal computer or from the Internet.

The toy can also form part of a system that provides the toy with new content if desired. For example, in some embodiments, a linker device can be used to transfer data (e.g., new audio data or code for new operating modes) between the toy and a computer (e.g., an Internet-enabled personal computer or server computer). The linker device can be any suitable linker device known to one skilled in the art, such as a wireless transceiver (e.g., a radio frequency [RF] transceiver or an infra-red [IR] transceiver) or a data port (e.g., a Universal Serial Bus [USB] data port). Such a data port enables a user to transfer data to, and from, the toy through a physical connection (e.g., a data cable) between the toy and a client PC or the Internet. The inclusion of a linker device in the system results in an Internet-enabled toy. Additional details regarding such Internet-enabled embodiments can be found in U.S. patent application Ser. No. 09/632,424, filed on Aug. 4, 2000. This U.S. patent application is herein incorporated by reference in its entirety for all purposes.

Embodiments of the invention have a number of advantages. First, embodiments of the invention are more interactive than, for example, ordinary non-electronic play shopping cart toys. Second, embodiments of the invention can teach a child in various ways and about multiple subjects. For example, the audio script above indicates that the shopping toys according to embodiments of the invention can be used to teach about numbers, food (e.g., food facts, food recognition), and colors substantially simultaneously. These and other subjects can be taught to a child while the child uses the child's kinesthetic ability, and auditory and visual senses. Using these three modes of interaction enhances and reinforces learning. Third, using embodiments of the invention, children can be introduced to or develop: language development (children are introduced to food names, food groups, number names, and the connection between numbers and quantities); reasoning skills (basic number skills are important building blocks for more complex mathematical concepts); exploration and creativity (children are encouraged to explore numbers, quantities, and counting as they engage in shopping role-play, and shopping role-play and character interaction encourages imaginative and creating play); cognitive development (following simple directions helps children develop cognitive skills and games help develop memory and reasoning skills and encourage learning play); and motor skills (scanning food items helps develop gross motor skills).

The terms and expressions which have been employed herein are used as terms of description and not of limitation, and there is no intention in the use of such terms and expressions of excluding equivalents of the features shown and described, or portions thereof, it being recognized that various modifications are possible within the scope of invention the claimed. For example, although audio playback devices are described in detail herein, it is understood that embodiments of the invention could use display devices (e.g., an LCD screen) as well. Moreover, one or more features of embodiments of the invention may be combined any one of more features of other embodiments of the invention without departing from the spirit and scope of the invention.

What is claimed is:

1. A toy comprising:

(a) a scannable toy item;

(b) an electronic scanner configured to identify the scannable toy item when the electronic scanner is brought within physical proximity to the scannable toy item; and (c) an audio playback device electronically coupled to the electronic scanner, wherein the audio playback device is configured to play an audio output that is uniquely associated with the scannable toy item, wherein the audio playback device is configured to play a first unique audio output in response to a first scan resulting in an initial identification of the scannable toy item by the electronic scanner and to play a second unique audio output in response to a second scan resulting in a subsequent indentification of the scannable toy item by the electronic scanner, and wherein the audio playback device is further configured to play an audio output that requests a child to scan the scannable toy item before the first scan of the scannable toy item.

2. The toy of claim 1, wherein the audio output describes an attribute of the scannable toy item.

3. The toy of claim 2, wherein the attribute of the scannable toy item is a color.

4. The toy of claim 2, wherein the attribute of the scannable toy item is a shape.

5. The toy of claim 2, wherein the attribute of the scannable toy item is a number.

6. The toy of claim 2, wherein the attribute of the scannable toy item is the name of the toy item.

7. The toy of claim 2, wherein the scannable item is a food item and the attribute is nutritional information associated with the food item.

8. The toy of claim 1, wherein the electronic scanner further includes a pressure switch in a scanning head portion, and wherein the audio playback device is configured to play a generic audio acknowledgement after the pressure switch is activated.

9. The toy of claim 1, wherein the audio output comprises at least one unique audio output and at least one non-unique audio output.

10. The toy of claim 1, further comprising a data input device electronically coupled with the audio playback device and adapted to receive additional data for use by the audio playback device.

11. The toy of claim 10, wherein the data input device is a slot adapted to receive a transferable information storage medium.

12. The toy of claim 1 wherein the scannable toy item is a scannable role-play toy item.

13. The toy of claim 1 further comprising a shopping cart, wherein the scannable toy item is to be placed in the shopping cart.

14. The toy of claim 1, further including an explore mode, a learn mode, and a game mode.

15. The toy of claim 14, wherein the learning mode teaches nutritional information about a food item.

16. The toy of claim 14, wherein the learning mode teaches colors.

17. The toy of claim 14, wherein the explore mode teaches nutritional information about a food item.

18. The toy of claim 14, wherein the game mode teaches numbers, the relationship between numbers, and the relationship between numbers and quantities.

19. The toy of claim 1 wherein the audio playback device comprises a memory comprising code for causing the audio playback device to play the first unique audio output in response to the initial identification of the scannable toy item by the electronic scanner and to play the second unique audio output in response to the subsequent identification of the scannable toy item by the electronic scanner.

20. The toy of claim 1 wherein the audio playback device comprises a memory comprising code for causing the audio playback device to play the first unique audio output in response to the initial identification of the scannable toy item by the electronic scanner and to play the second unique audio output in response to the subsequent identification of the scannable toy item by the electronic scanner, and wherein the first unique audio output comprises a first synthesized speech output and the second audio output comprises a second synthesized speech output, and wherein the first and second synthesized speech outputs are different.

21. A toy comprising:

(a) a scannable toy item;

(b) an electronic scanner configured to identify the scannable toy item when the electronic scanner is brought within physical proximity to the scannable toy item; and (c) an audio playback device electronically coupled to the electronic scanner, wherein the audio playback device is configured to play an audio output that is uniquely associated with the scannable toy item, wherein the audio playback device is configured to play a first unique audio output in response to an initial identification of the scannable toy item by the electronic scanner and to play a second unique audio output in response to a subsequent identification of the scannable toy item by the electronic scanner, and wherein the audio playback device is further configured to play an audio output that requests a child to scan the scannable toy item before the child has scanned the scannable toy item, and wherein the scannable toy item includes an RF identification tag that is used to provide the initial identification and the subsequent identification, and wherein the electronic scanner includes an RF identification tag reader adapted to read the RF identification tag.

22. A toy comprising:

(a) a scannable toy item;

(b) an electronic scanner configured to identify the scannable toy item when the electronic scanner is brought within physical proximity to the scannable toy item; and (c) an audio playback device electronically coupled to the electronic scanner, wherein the audio playback device is configured to play a first unique audio output in response to an initial identification of the scannable toy item by the electronic scanner and to play a second unique audio output in response to a subsequent identification of the scannable toy item by the electronic scanner, and wherein the audio playback device is configured to play an audio output that is uniquely associated with the scannable toy item, wherein the toy has at least two of a learn mode, a game mode, and an explore mode.

23. The toy of claim 22, further comprising a mode switch configured to change the operational mode of the toy.

24. A toy comprising:

(a) a scannable toy item;

(b) an electronic scanner configured to identify the scannable toy item when the electronic scanner is brought within physical proximity to the scannable toy item; and (c) an audio playback device electronically coupled to the electronic scanner, wherein the audio playback device is configured to play an audio output that is uniquely associated with the scannable toy item, wherein the audio playback device is configured to play a first unique audio output in response to an initial identification of the scannable toy item by the electronic scanner and to play a second unique audio output in response to a subsequent identification of the scannable toy item by the electronic scanner, and wherein the audio playback device is further configured to play an audio output that requests a child to scan the scannable toy item before the child has scanned the scannable toy item, and wherein the toy further includes an explore mode, a learning mode, and a game mode, wherein the learning mode teaches numbers, the relationship between numbers, and the relationship between numbers and quantities.

25. A toy comprising:

a plurality of scannable toy items comprising a first food item comprising a first quantity of food objects and a second food item comprising a second quantity of food objects, wherein the first and second food items comprise RF ID chips inside the first and second food items;

an electronic scanner configured to scan and identify the first food item when the electronic scanner is brought within physical proximity to the first food item and is configured to identify the second food item when the electronic scanner is brought into physical proximity to the second food item;

an audio playback device electronically coupled to the electronic scanner, wherein the audio playback device is configured to play a first unique audio output in response to an initial scan of the first food item by the electronic scanner and to play a second unique audio output in response to a subsequent scan of the first food item by the electronic scanner, wherein the audio playback device is further configured to play an audio output that requests a child to scan the scannable toy item before the initial scan of the first toy item, and wherein the toy further includes an explore mode, a learning mode, and a game mode, and wherein in the learning mode, the toy prompts a user to select a predetermined set of the plurality of food items to make a meal or a snack.

26. The toy of claim 25 wherein the toy items have numbers printed on them.

27. The toy of claim 25 further comprising a shopping cart for holding the toy items.

28. The toy of claim 25 wherein the toy is adapted to teach the user about the numbers, colors, names, and nutritional information associated with the first and second food items.

* * * * *